US012796788B2

(12) United States Patent
Sakamoto et al.

(10) Patent No.: US 12,796,788 B2
(45) Date of Patent: Nov. 17, 2026

(54) SLIDE FASTENER AND METHOD FOR MANUFACTURING SEPARABLE BOTTOM END STOP BOX FOR SLIDE FASTENER

(71) Applicant: YKK Corporation, Tokyo (JP)

(72) Inventors: Yoshito Sakamoto, Toyama (JP); Eiji Nakayama, Toyama (JP); Shingo Hinata, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 19/124,216

(22) PCT Filed: Oct. 28, 2022

(86) PCT No.: PCT/JP2022/040570

§ 371 (c)(1),
(2) Date: Apr. 24, 2025

(87) PCT Pub. No.: WO2024/089902

PCT Pub. Date: May 2, 2024

(65) Prior Publication Data

US 2026/0165428 A1 Jun. 18, 2026

(51) Int. Cl.

| | |
|---|---|
| ***A44B 19/38*** | (2006.01) |
| ***A44B 19/26*** | (2006.01) |
| ***A44B 19/28*** | (2006.01) |

(52) U.S. Cl.

CPC ..... *A44B 19/38* (2013.01); *A44B 19/26* (2013.01); *A44B 19/262* (2013.01); *A44B 19/285* (2013.01); *A44B 19/388* (2013.01)

(58) Field of Classification Search

CPC ..... A44B 19/38; A44B 19/26; A44B 19/262; A44B 19/285; A44B 19/388

See application file for complete search history.

(56) References Cited

U.S. PATENT DOCUMENTS 2,146,691 A * 2/1939 Sundback ..... A44B 19/38 24/433
2,157,381 A * 5/1939 Carlile ..... A44B 19/38 24/388

(Continued)

FOREIGN PATENT DOCUMENTS

CN 206043646 U 3/2017
CN 210492905 U 5/2020

(Continued)

OTHER PUBLICATIONS

International Preliminary Report on Patentability, PCT Patent Application No. PCT/JP2022/040570, Apr. 29, 2025, 9 pages.

(Continued)

*Primary Examiner* — Jason W San
(74) *Attorney, Agent, or Firm* — Kilpatrick Townsend & Stockton LLP

(57) ABSTRACT

In a slide fastener, among inner surfaces forming a separable pin hole of a retainer, at least one of a front side surface and a back side surface facing a front surface and a back surface of a separable pin is provided with a convex portion engageable with a recess. The convex portion includes an upper inclined surface that increases a thickness of the convex portion downward from an upper end portion of the convex portion in the insertion or removal direction of the separable pin, and a lower inclined surface that increases the thickness of the convex portion upward from a lower end portion of the convex portion in the insertion or removal direction of the separable pin. An inclination of the upper inclined surface is larger than an inclination of the lower inclined surface.

9 Claims, 29 Drawing Sheets

(56) References Cited

U.S. PATENT DOCUMENTS

| | | | | | |
|---|---|---|---|---|---|
| 2,583,386 | A * | 1/1952 | Moehler | A44B 19/38 | 24/433 |
| 2,649,638 | A * | 8/1953 | Morin | A44B 19/382 | 24/433 |
| 3,858,283 | A * | 1/1975 | Runnels | A44B 19/38 | 24/388 |
| 4,193,172 | A * | 3/1980 | Kanzaka | A44B 19/262 | 16/110.1 |
| 4,536,923 | A * | 8/1985 | Murakami | A44B 19/38 | 24/433 |
| 4,562,622 | A * | 1/1986 | Takabatake | A44B 19/26 | 24/415 |
| 5,388,312 | A * | 2/1995 | Fudaki | A44B 19/38 | 24/433 |
| 5,412,849 | A * | 5/1995 | Fudaki | A44B 19/38 | 24/433 |
| 5,507,610 | A * | 4/1996 | Benedetti | F16B 5/0628 | 411/908 |
| 5,638,585 | A * | 6/1997 | Mizuno | A44B 19/38 | 24/433 |
| 6,481,068 | B1 * | 11/2002 | Takasawa | A44B 19/38 | 24/433 |
| 7,320,158 | B2 * | 1/2008 | Deto | A41F 1/002 | 24/433 |
| 7,690,089 | B2 * | 4/2010 | Keyaki | A44B 19/388 | 24/433 |
| 7,954,205 | B2 * | 6/2011 | Xueyong | F16B 5/128 | 24/297 |
| 8,495,802 | B2 * | 7/2013 | Okada | B60R 13/0206 | 24/453 |
| 8,511,631 | B2 * | 8/2013 | Kato | F16B 21/086 | 24/297 |
| 8,813,319 | B2 * | 8/2014 | Ogura | A44B 19/382 | 24/434 |
| 9,027,210 | B2 * | 5/2015 | Peters | A44B 19/388 | 24/433 |
| 9,216,703 | B2 * | 12/2015 | Lauxen | B60R 13/0206 | |
| 9,549,593 | B2 * | 1/2017 | Kojima | A44B 19/382 | |
| 9,938,997 | B2 * | 4/2018 | Iwahara | F16B 5/0664 | |
| 10,125,804 | B2 * | 11/2018 | Krippl | F16B 21/09 | |
| 10,137,846 | B2 * | 11/2018 | Shen | B60R 13/0212 | |
| 10,578,138 | B2 * | 3/2020 | Izumi | F16B 19/00 | |
| 11,202,487 | B2 * | 12/2021 | Tung | A44B 19/388 | |
| 11,291,276 | B1 | 4/2022 | Chung | | |
| 11,432,622 | B2 * | 9/2022 | Owings | A44B 19/06 | |
| 2002/0038496 | A1 * | 4/2002 | Yamagishi | A44B 19/26 | 24/427 |
| 2003/0115725 | A1 * | 6/2003 | Matsumoto | A44B 19/388 | 24/433 |
| 2003/0213106 | A1 * | 11/2003 | Ichikawa | A44B 19/388 | 24/433 |
| 2007/0107174 | A1 * | 5/2007 | Bordas | F16B 5/0657 | 24/664 |
| 2008/0040901 | A1 * | 2/2008 | Himi | A44B 19/38 | 24/433 |
| 2009/0049659 | A1 * | 2/2009 | Takani | A44B 19/26 | 24/426 |
| 2012/0000040 | A1 * | 1/2012 | Ogura | A44B 19/382 | 24/391 |
| 2013/0139362 | A1 * | 6/2013 | Sato | A44B 19/28 | 24/427 |
| 2013/0139363 | A1 * | 6/2013 | Sato | A44B 19/303 | 24/427 |
| 2017/0127771 | A1 * | 5/2017 | Sato | A44B 19/38 | |
| 2019/0142116 | A1 * | 5/2019 | Cheng | A44B 19/34 | 24/389 |
| 2019/0223561 | A1 * | 7/2019 | Kojima | A44B 19/26 | |
| 2026/0000162 | A1 * | 1/2026 | Katsuki | A44B 19/26 | |
| 2026/0076457 | A1 * | 3/2026 | Li | A44B 19/388 | |

FOREIGN PATENT DOCUMENTS

| | | | |
|---|---|---|---|
| CN | 214340524 | U | 10/2021 |
| JP | S55-093308 | U | 6/1980 |
| JP | S57-111213 | | 7/1982 |
| JP | S63-073014 | U | 5/1988 |
| JP | H07-003925 | Y2 | 2/1995 |
| KR | 10-2016-0002002 | A | 1/2016 |
| WO | 2012-042602 | A1 | 4/2012 |
| WO | 2015-052756 | A1 | 4/2015 |
| WO | 2019-186966 | A1 | 10/2019 |

OTHER PUBLICATIONS

International Search Report, PCT Patent Application No. PCT/JP2022/040570, Jan. 10, 2023, 5 pages.

Written Opinion, PCT Patent Application No. PCT/JP2022/040570, Jan. 10, 2023, 9 pages.

* cited by examiner

SLIDE FASTENER AND METHOD FOR MANUFACTURING SEPARABLE BOTTOM END STOP BOX FOR SLIDE FASTENER

TECHNICAL FIELD

The present invention relates to a slide fastener and a method for manufacturing a retainer of a slide fastener separating insert.

BACKGROUND ART

A slide fastener separating insert is generally provided at lower end portions of left and right fastener stringers, and includes one of left and right separable pin and another of left and right retainer. In the fastener stringer, an element row is attached to an inner edge portion of a fastener tape. In an open state of the left and right fastener elements in which a slider between the left and right fastener stringers is lowered to the lowest position where the slider abuts against the separating insert, the separable pin is removed from the retainer, and the separable pin is pulled up through an element guide path of the slider, whereby the left and right fastener stringers can be separated. In addition, from this separated state, the separable pin of one fastener stringer is passed through the element guide path of the slider at the lowest position in contact with the retainer in another fastener stringer, and then inserted into the retainer, whereby the lower end portions of the left and right fastener stringers are aligned. By moving the slider upward from this alignment state, a space between the fastener elements of the left and right fastener stringers can be closed.

When the slider is moved upward in a state where the separable pin is not completely inserted into the retainer, that is, in a state where the lower end portions of the left and right fastener stringers are not aligned, an improper combination of the left and right fastener stringers may occur. In order to prevent such an event, it is desirable that a user can recognize that the lower end portions of the pair of left and right fastener stringers are in an alignment state.

For example, Patent Literature 1 discloses a separating insert for a slide fastener in which a separable pin is freely fitted into a retaining box to be substantially parallel to a retainer pin. In the separating insert for the slide fastener, a recess is provided in a tip end portion on either one surface or both surfaces of front and back surfaces of the separable pin, and a convex member that enters the recess is provided on an inner surface of an engagement hole of the retaining box in which the separable pin is fitted. Therefore, since the recess of the separable pin is engaged with and held by the convex member of the retaining box in a state where the separable pin is completely inserted into the retainer, and the resistance feeling is generated when the separable pin is removed from the retaining box, when the user attempts to remove the separable pin from the retaining box, the user can recognize that the lower end portions of the pair of left and right fastener stringers are in the alignment state.

CITATION LIST

Patent Literature

Patent Literature 1: JPH07-3925Y

SUMMARY OF INVENTION

Technical Problem

Here, a main object of the slide fastener disclosed in Patent Literature 1 is that the separable pin can be easily inserted into the retaining box even in a one-handed operation, and by forming an inclined cam surface in the separable pin both while a tapered surface is formed in the convex member, the separable pin can smoothly be inserted into an engagement hole with a small resistance for hitting the convex member when the separable pin is inserted into the engagement hole. Therefore, when the separable pin is inserted into the retaining box, since the resistance feeling and sound are hardly generated, it may be difficult for the user to recognize the insertion feeling.

The present invention has been made in view of the above problems, and an object of the present invention is to provide a slide fastener and a method for manufacturing a retainer of a slide fastener separating insert, in which a user can appropriately recognize that a separable pin is inserted into a retainer.

Solution to Problem

In order to solve the above problems, the present invention is achieved by the following configurations.

[1] A slide fastener (100) including:

a pair of first and second fastener stringers (30A, 30B);

at least one slider (40) configured to open and close a space between the first and second fastener stringers (30A, 30B); and a separating insert (1) provided at a lower end portion of the first and second fastener stringers (30A, 30B) in a longitudinal direction, in which the separating insert (1) includes a first separating insert portion (10) provided on the first fastener stringer (30A), and a second separating insert portion (20) provided on the second fastener stringer (30B) and capable of being coupled to and decoupled from the first separating insert portion (10), the first separating insert portion (10) includes a separable pin (11) provided on a width direction inner edge side of the first fastener stringer (30A), the second separating insert portion (20) includes a retainer (21) provided on a width direction inner edge side of the second fastener stringer (30B), the retainer (21) includes a separable pin hole (25) which opens to an upper side and into or from which the separable pin (11) can be inserted or removed in the longitudinal direction, at least one of a front surface (11*b*) and a back surface (11*c*) of the separable pin (11) is provided with a recess (16, 17), among inner surfaces (25*a*, 25*b*, 25*c*, 25*d*) forming the separable pin hole (25) of the retainer (21), at least one of a front side surface (25*a*) and a back side surface (25*b*) facing the front surface (11*b*) and the back surface (11*c*) of the separable pin (11) is provided with a convex portion (26, 27) engageable with the recess (16, 17), the convex portion (26, 27) has a non-symmetrical shape with respect to a plane (P) passing through a central portion of the convex portion (26, 27) in an insertion or removal direction of the separable pin (11) and perpendicular to the insertion or removal direction, the convex portion (26, 27) includes an upper inclined surface (26*a*, 27*a*) that increases a thickness of the convex portion (26, 27) downward from an upper end portion of the convex portion (26, 27) in the insertion or removal direction of the separable pin (11), and a lower inclined surface (26*b*, 27*b*) that increases the thickness of the convex portion (26, 27) upward from a lower end portion of the convex portion (26, 27) in the insertion or removal direction of the separable pin (11), and an inclination of the upper inclined surface (26*a*, 27*a*) is larger than an inclination of the lower inclined surface (26*b*, 27*b*).

[2] A slide fastener (100) including:

a pair of first and second fastener stringers (30A, 30B);

at least one slider (40) configured to open and close a space between the first and second fastener stringers (30A, 30B); and a separating insert (1) provided at a lower end portion of the first and second fastener stringers (30A, 30B) in a longitudinal direction, in which the separating insert (1) includes a first separating insert portion (10) provided on the first fastener stringer (30A), and a second separating insert portion (20) provided on the second fastener stringer (30B) and capable of being coupled to and decoupled from the first separating insert portion (10), the first separating insert portion (10) includes a separable pin (11) provided on a width direction inner edge side of the first fastener stringer (30A), the second separating insert portion (20) includes a retainer (21) provided on a width direction inner edge side of the second fastener stringer (30B), the retainer (21) includes a separable pin hole (25) which opens to an upper side and into or from which the separable pin (11) can be inserted or removed in the longitudinal direction, at least one of a front surface (11*b*) and a back surface (11*c*) of the separable pin (11) is provided with a recess (16, 17), among inner surfaces (25*a*, 25*b*, 25*c*, 25*d*) forming the separable pin hole (25) of the retainer (21), at least one of a front side surface (25*a*) and a back side surface (25*b*) facing the front surface (11*b*) and the back surface (11*c*) of the separable pin (11) is provided with a convex portion (26, 27) engageable with the recess (16, 17), and a force (Fin) required to insert the separable pin into the separable pin hole (25) of the retainer is larger than a force (Fout) required to remove the separable pin from the separable pin hole (25) of the retainer.

[3] A method for manufacturing a retainer (21) of a slide fastener separating insert (1), in which the retainer (21) is provided with a convex portion (26, 27) on an inner surface (25*a*, 25*b*) of a separable pin hole (25) into or from which a separable pin (11) can be inserted and removed, the retainer (21) is obtained by injection molding using a fixed mold (5), a movable mold (6) provided to be capable of reciprocating in a front-back direction with respect to the fixed mold (5), and first and second slides (7, 8) provided to be capable of reciprocating in an upper-lower direction with respect to the fixed mold (5), and a convex portion forming portion (26*z*) for forming the convex portion (26, 27) is formed by abutting a first recess (26*x*) recessed in the first slide (7) against a second recess (26*y*) recessed in the second slide (8).

Advantageous Effects of Invention

The present invention provides a slide fastener and a method for manufacturing a retainer of a slide fastener separating insert, in which a user can appropriately recognize that a separable pin is inserted into a retainer.

Figure 16:
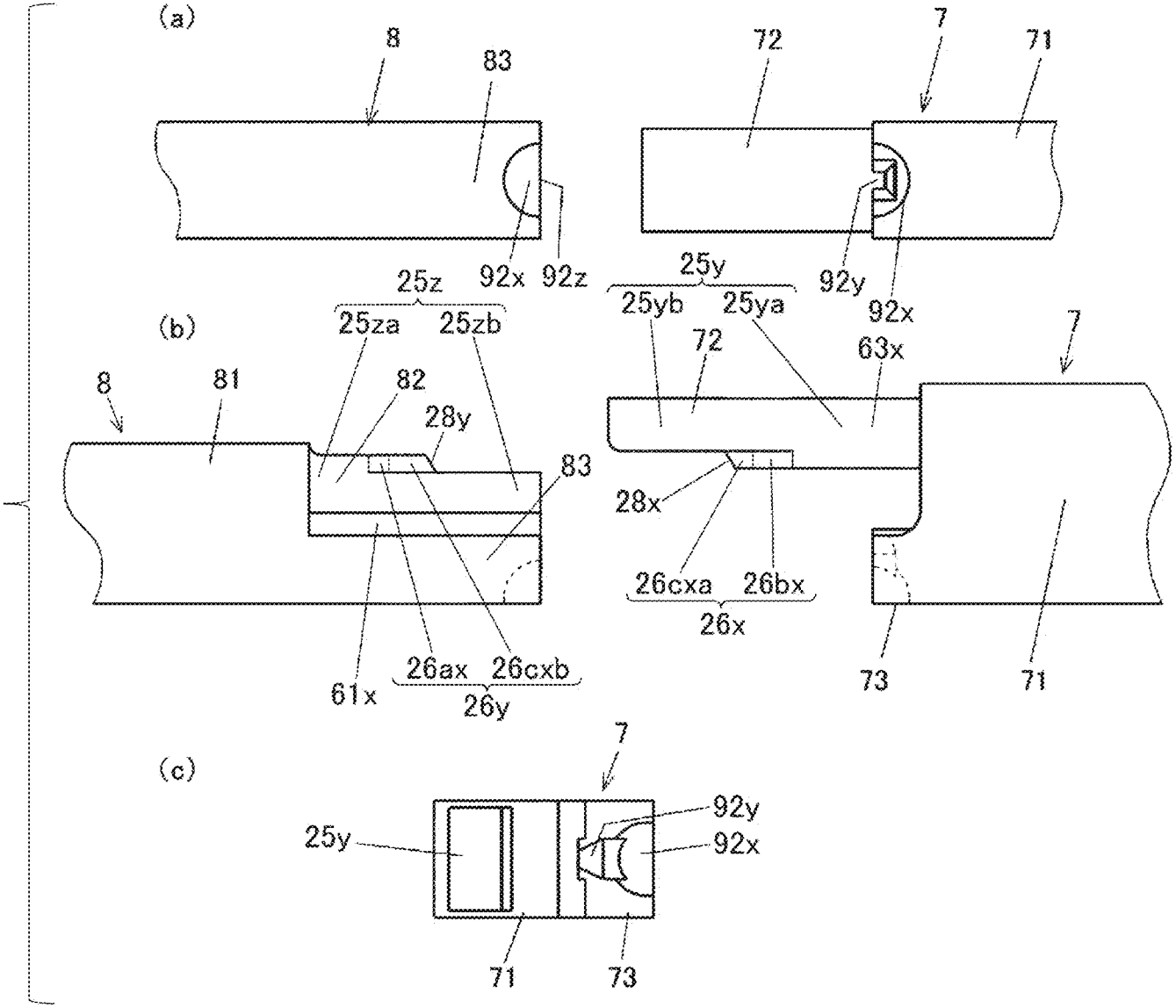

(a) of FIG. 16 is a side view of first and second slides in a mold opening state as viewed from the width direction, (b) of FIG. 16 is a front view of the first and second slides in the mold opening state as viewed from the front surface side, and (c) of FIG. 16 is a top view of the first slide as viewed from above.

Figure 17:
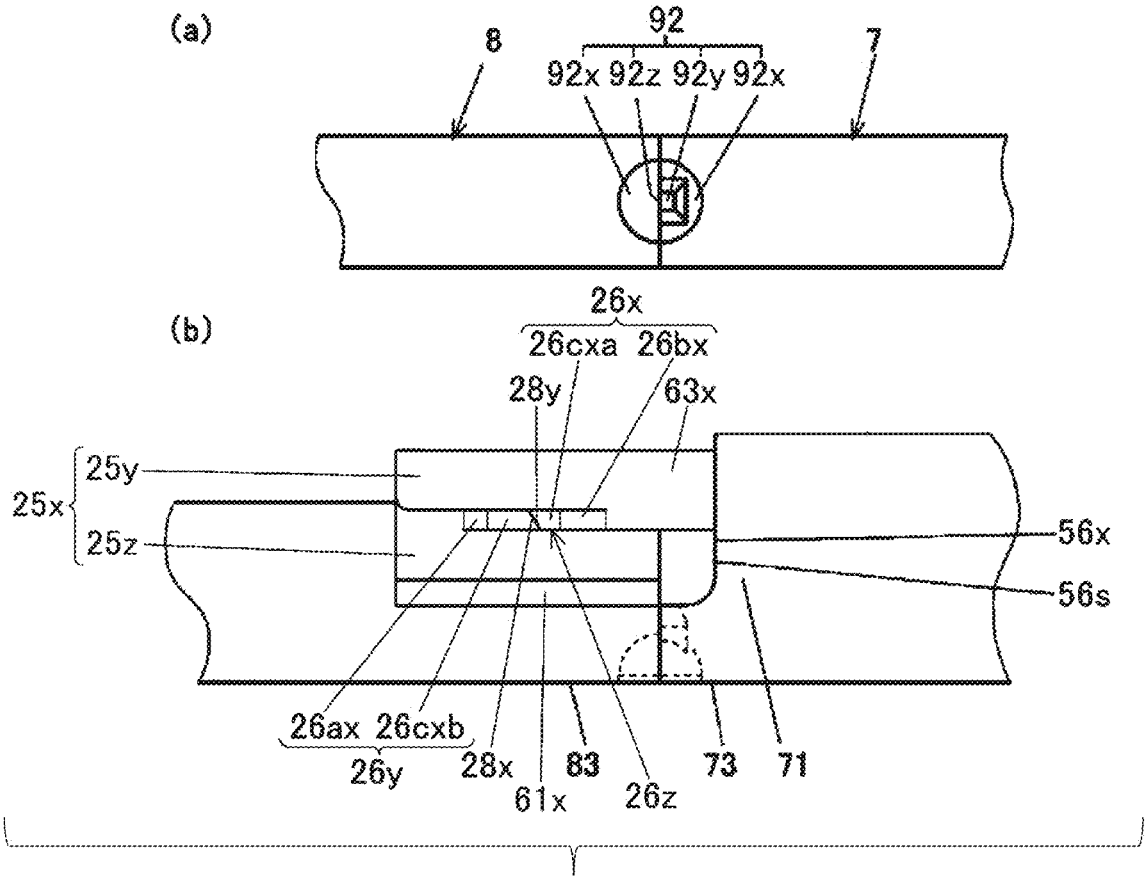

(a) of FIG. 17 is a side view of the first and second slides in a mold clamping state as viewed from the width direction, and (b) of FIG. 17 is a front view of the first and second slides in the mold clamping state as viewed from the front surface side.

Figure 18:
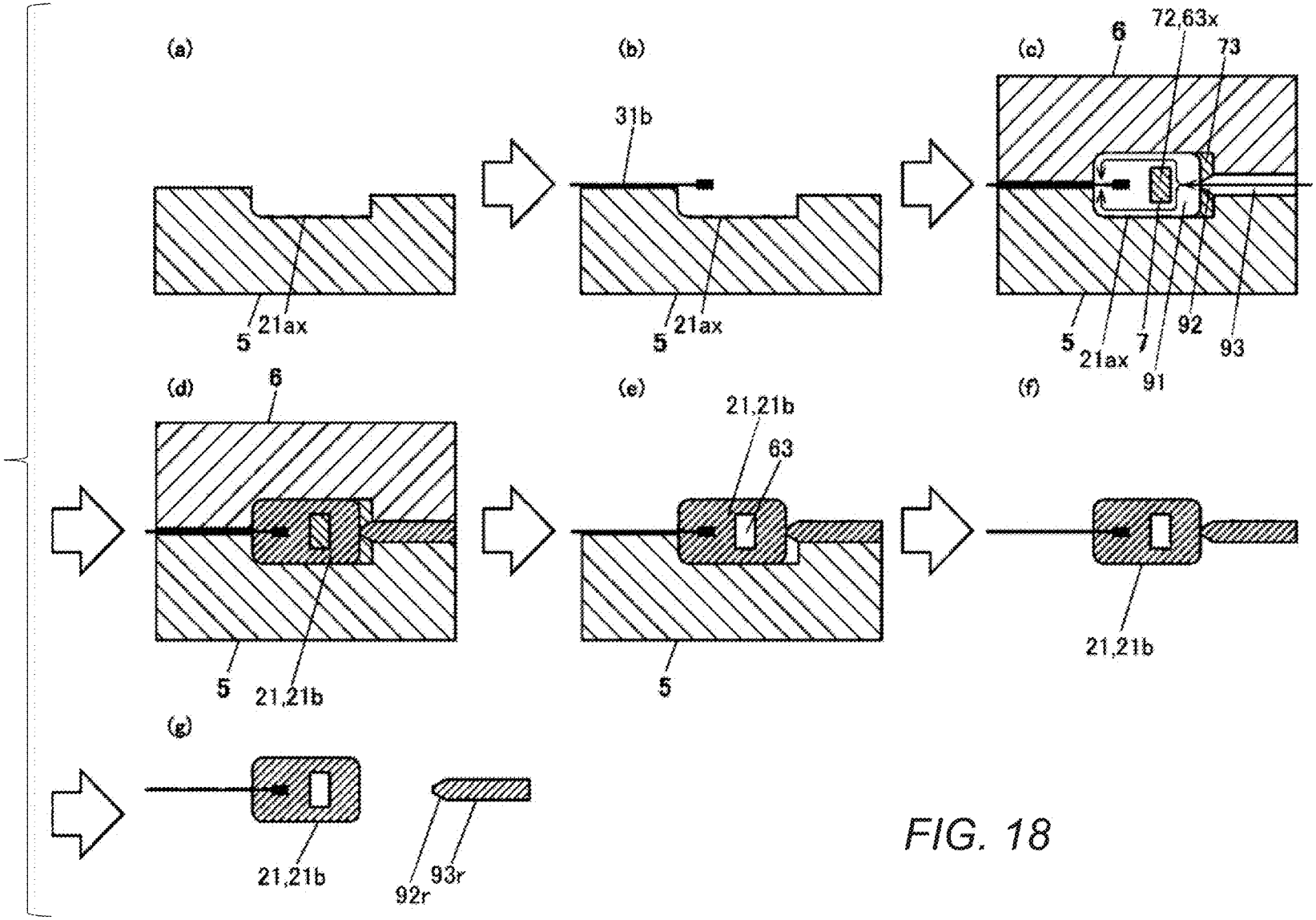

(a) to (g) of FIG. 18 are process diagrams showing procedures of an injection molding method.

Figure 19:
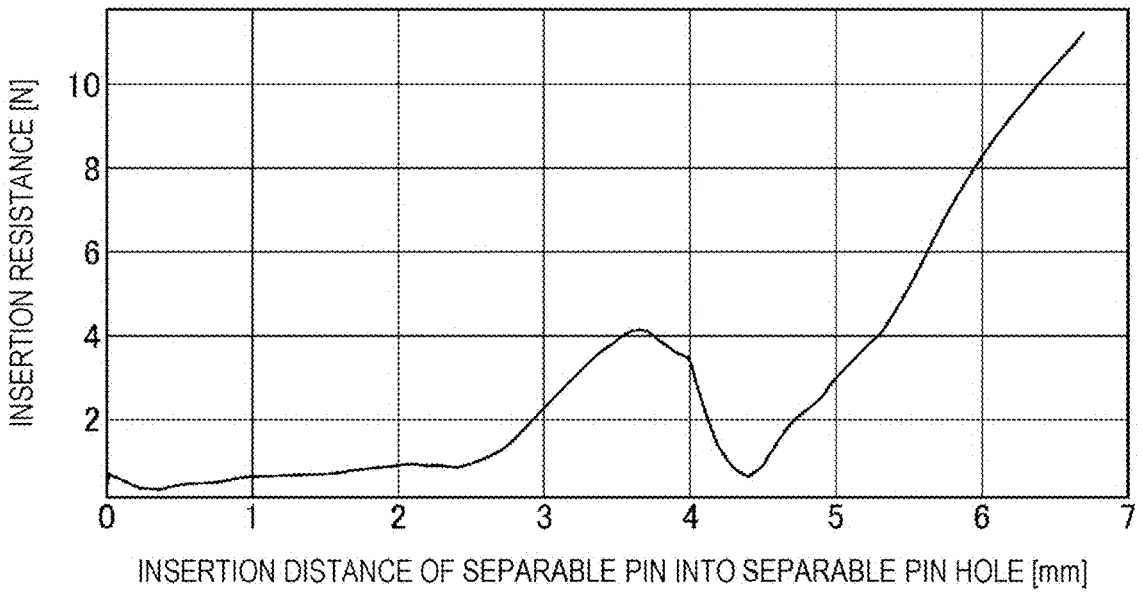

FIG. 19 is a graph showing an example of a relation between an insertion distance (horizontal axis) of the separable pin into the separable pin hole and an insertion resistance (vertical axis).

Figure 20:
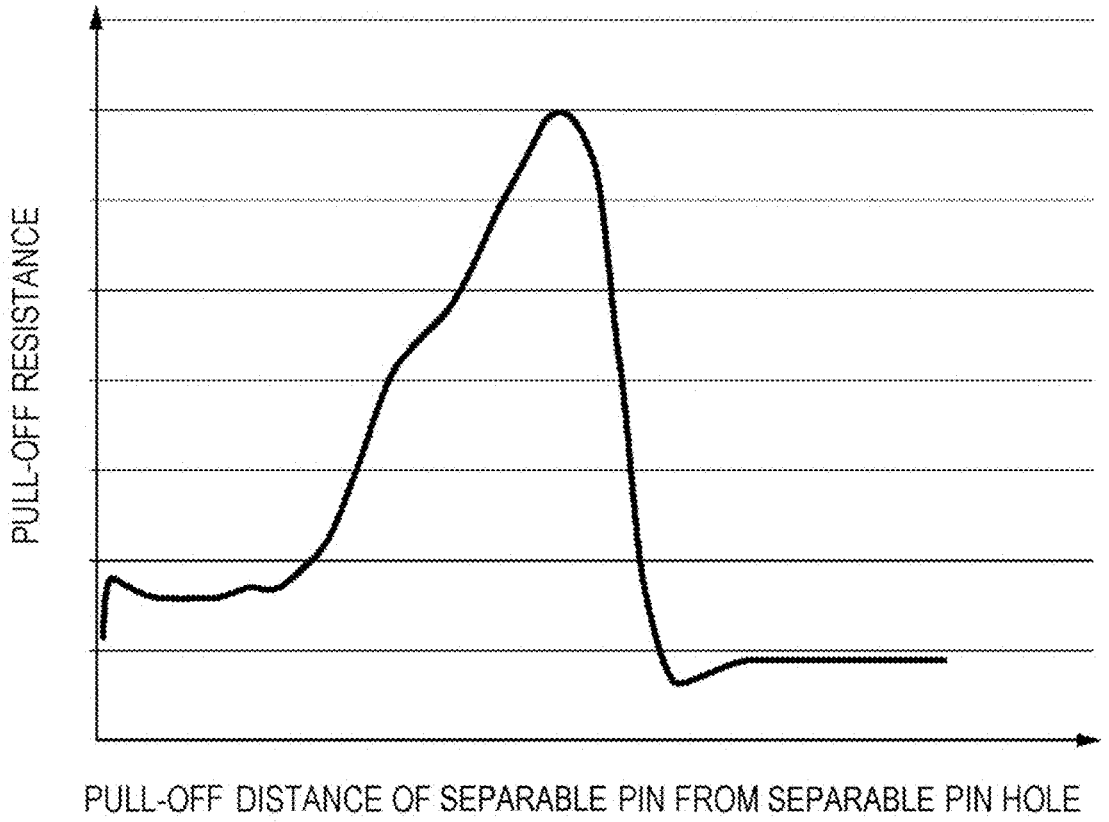

FIG. 20 is a graph showing an example of a relation between a pull-off distance (horizontal axis) of the separable pin from the separable pin hole and a pull-off resistance (vertical axis).

DESCRIPTION OF EMBODIMENTS

Hereinafter, a slide fastener and a method for manufacturing a retainer of a slide fastener separating insert according to embodiments of the present invention will be described in detail with reference to the drawings.

In the present specification, an "upper-lower direction" is a sliding direction of a slider, is a longitudinal direction of a slide fastener or a fastener stringer, and is an insertion or removal direction of a separable pin into or from a retainer. In the "upper-lower direction", a direction in which the slider slides to mesh the left and right element rows is referred to as "upward", and a direction in which the slider slides to separate the left and right element rows is referred to as "downward".

In addition, a "left-right direction" refers to a direction in which a pair of element rows are arranged, perpendicular to the sliding direction of the slider, and can also be referred as a width direction of a slide fastener, a fastener stringer, an element, a separable pin, and a retainer.

Further, a "front-back direction" is a direction orthogonal to the upper-lower direction and the left-right direction, and can be referred as a thickness direction of a slide fastener, a fastener stringer, an element, a separable pin, and a retainer.

First Embodiment

Figure 1:
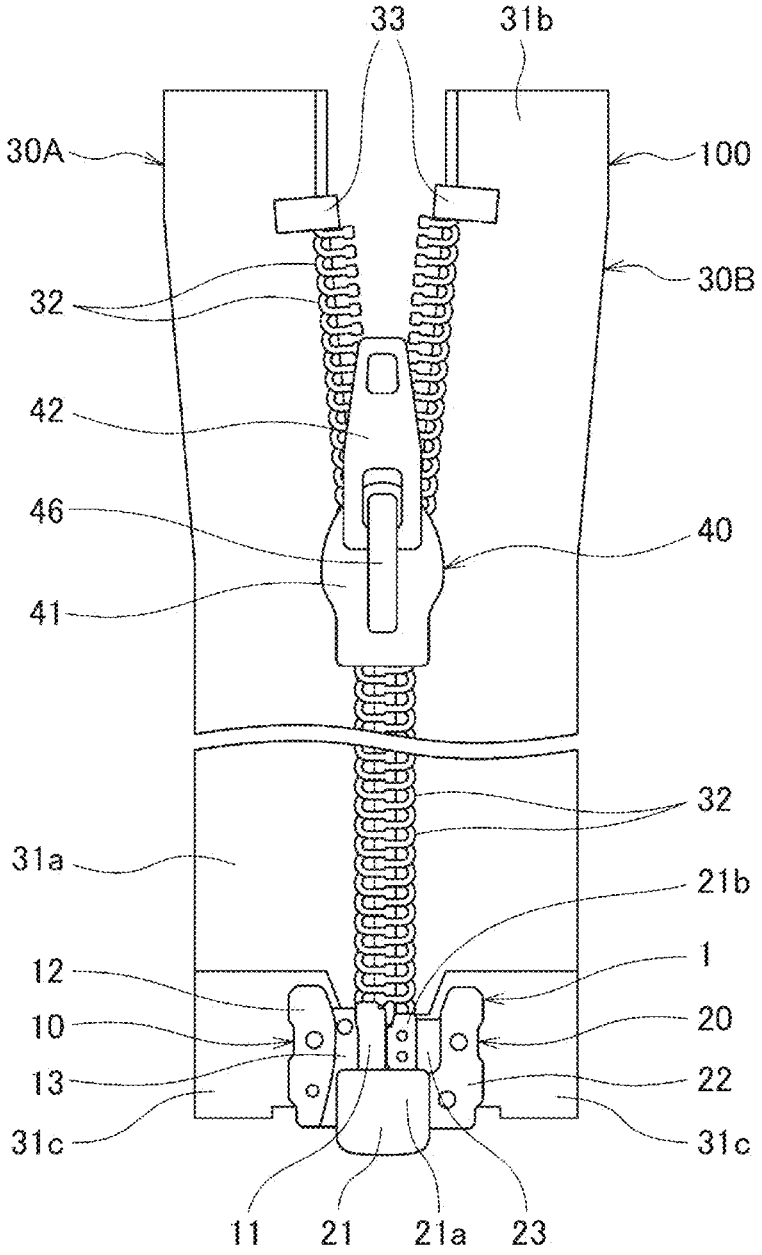
FIG. 1 is a front view of a slide fastener 100 according to a first embodiment of the present invention.
Figure 2:
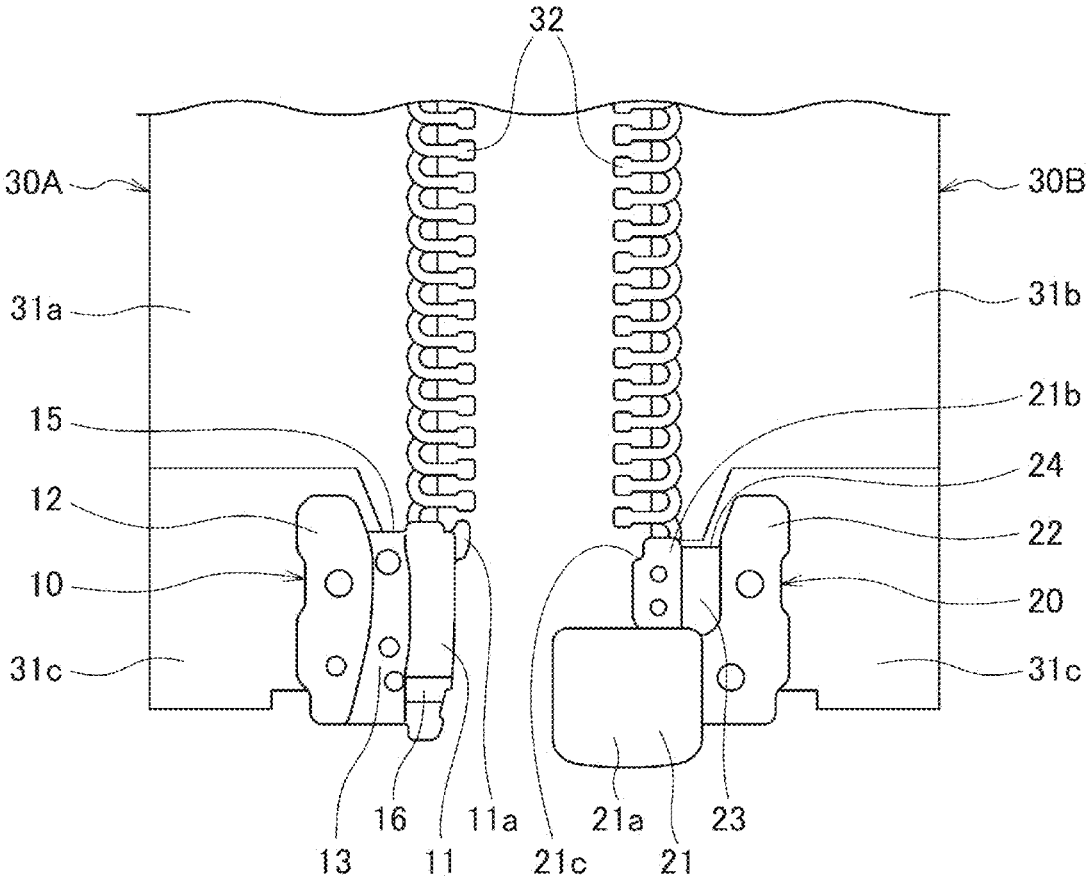
FIG. 2 is an enlarged front view showing a decoupling state of first and second separating insert portions, in which first and second fastener stringers are separated from each other.
Figure 3:
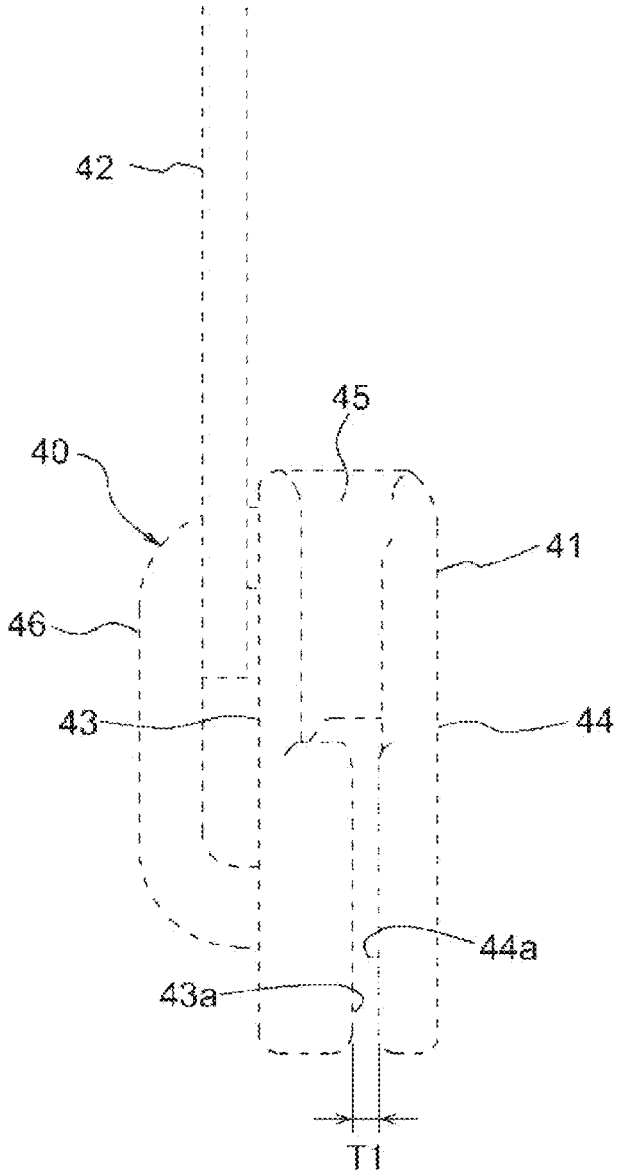
FIG. 3 is a side view of a slider shown by a broken line.

FIG. 1 is a front view of a slide fastener 100 according to a first embodiment of the present invention. FIG. 2 is an enlarged front view showing a decoupling state of first and second separating insert portions, in which first and second fastener stringers are separated from each other. FIG. 3 is a side view of a slider shown by a broken line.

As shown in FIGS. 1 and 2, the slide fastener 100 includes a pair of first and second fastener stringers (hereinafter, a fastener stringer is simply referred to as a "stringer") 30A, 30B on the left and right sides, one slider 40 that opens and closes a space between the first and second stringers 30A, 30B by moving a user in the upper-lower direction, and a slide fastener separating insert (hereinafter, referred to as "separating insert") 1 according to one embodiment of the present invention, which is formed at lower end portions of the first and second stringers 30A, 30B in a longitudinal direction (upper-lower direction). In this example, the number of sliders 40 between the first and second stringers 30A, 30B is one, and may be two or more.

The first and second stringers 30A, 30B include strip-shaped fastener tapes (hereinafter, also simply referred to as a "tape") 31*a*, 31*b* that are elongated in the upper-lower direction, coil fastener elements (hereinafter, also simply referred to as an "element") 32 that are attached along inner edge portions which are opening and closing side edge portions in a width direction of the tapes 31*a*, 31*b*, and top stoppers 33 that restrict upward movement of the slider 40, respectively.

Hereinafter, the tape 31*a* forming the first stringer 30A may be referred to as a first tape, and the tape 31*b* forming the second stringer 30B may be referred to as a second tape. In this example, the tapes 31*a*, 31*b* are formed by weaving or knitting polyamide fibers, polyester fibers, acrylic fibers, and the like, and each of the elements 32 is made of a synthetic resin such as polyester or nylon, but is not limited to these. The element 32 is not limited to a coil element, and may be of a type in which each element is independent.

The slider 40 includes a slider body 41 and a pull 42 coupled to the slider body 41. Referring also to FIG. 3 in which a side surface of the slider 40 is indicated by a broken line, the slider body 41 includes an upper blade 43 disposed on a front side of the first and second stringers 30A, 30B, and a lower blade 44 disposed on a back side of the first and second stringers 30A, 30B. The upper blade 43 and the lower blade 44 are coupled to each other by a guide column 45 at an upper and intermediate position in the left-right direction between the upper blade 43 and the lower blade 44, thereby defining a Y-shaped element guide path that branches upwardly between the upper blade 43 and the lower blade 44.

Reference numeral 46 in FIGS. 1 and 3 denotes a pull holding portion to which the pull 42 is coupled, and the pull holding portion 46 protrudes from the upper blade 43. In a state where lower end portions of the first and second stringers 30A, 30B shown in FIG. 1 are coupled to each other by a separating insert 1 to be described later, when the user holds the pull 42 to move the slider body 41 to an upper side, the left and right elements 32 pass through the element guide path between the upper blade 43 and the lower blade 44, and the space between the first and second stringers 30A, 30B are closed. When the slider body 41 is moved to the lower side, the left and right elements 32 are disengaged from each other, and the space between the first and second stringers 30A, 30B are opened.

A raised portion 43*a* (see FIG. 3) raised to a lower blade 44 side is provided on left and right sides below the upper blade 43 so that the left and right elements 32 are not detached from the element guide path. A raised portion 44*a* slightly raised to an upper blade 43 side is also provided on left and right sides below the lower blade 44. An interval Tl between the raised portions 43*a*, 44*a* is the minimum interval between the upper blade 43 and the lower blade 44. This minimum interval Tl is smaller than the maximum thickness of the element 32 in the front-back direction and is larger than a thickness of the tape 31.

The separating insert 1 may be molded by injection molding or extrusion molding of a thermoplastic resin such as polyacetal, polyamide, polypropylene, and poly butylene terephthalate on a tape reinforcing portion 31*c* in which lower end portions of the left and right tapes 31*a*, 31*b* are reinforced with a thermoplastic resin. The tape reinforcing portion 31*c* is formed by welding a thermoplastic resin film such as polyamide or polyethylene to the lower end portions of the left and right tapes 31*a*, 31*b* by ultrasonic processing or the like, or by allowing the thermoplastic resin liquid to permeate and solidify. The tape reinforcing portion 31*c* is preferably provided over an entire length in the width direction of the tapes 31*a*, 31*b*.

The separating insert 1 includes a first separating insert portion 10 provided at a lower end portion of the first stringer 30A and a second separating insert portion 20 provided at a lower end portion of the second stringer 30B. The first separating insert portion 10 can be coupled to and decoupled from the second separating insert portion 20, a coupling state of the first and second separating insert portions 10, 20 is shown in FIG. 1, and a decoupling state of the first and second separating insert portions 10, 20 is shown in FIG. 2 in an enlarged manner.

Figure 4:
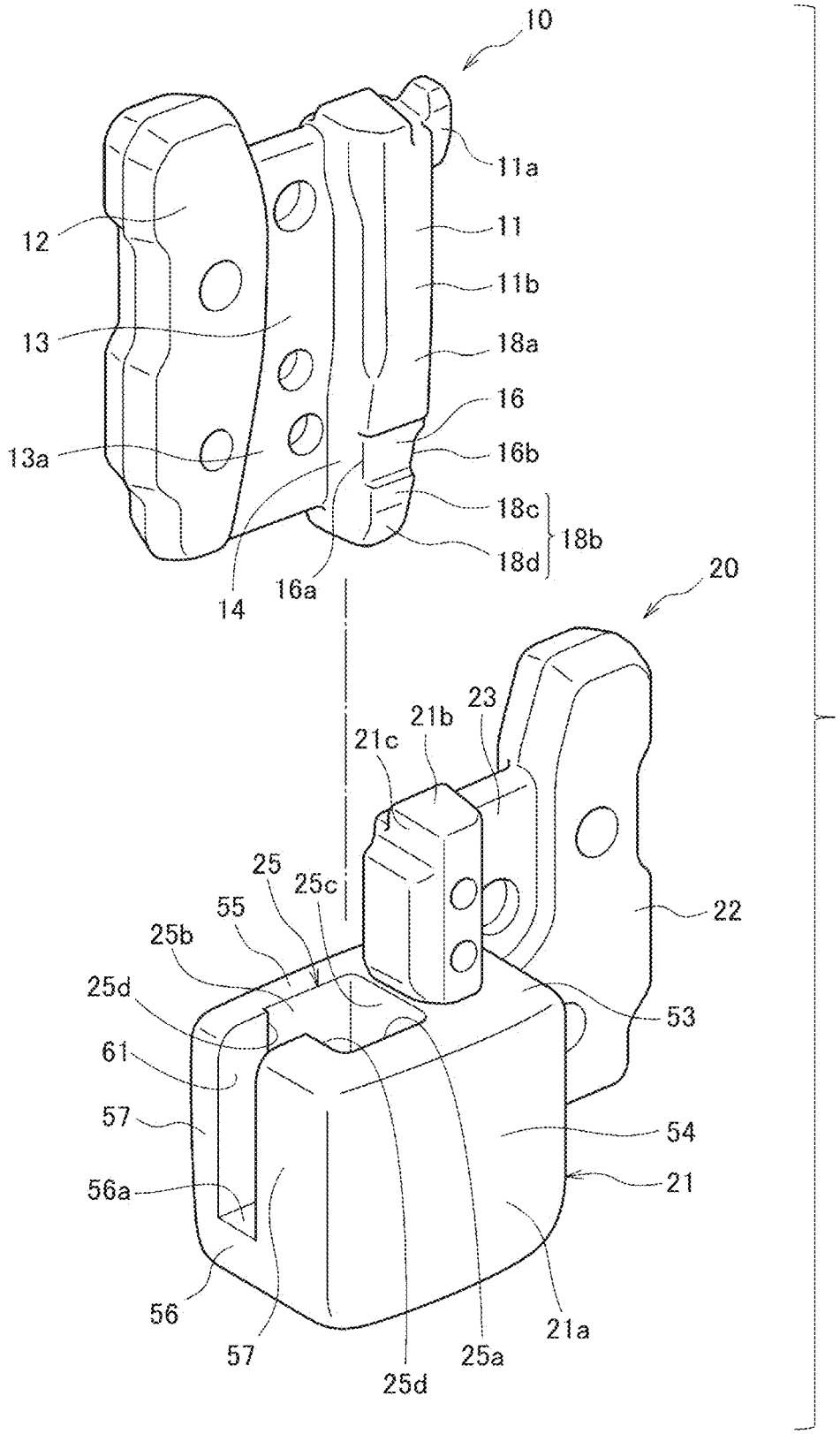
FIG. 4 is a perspective view of the first separating insert portion and the second separating insert portion.
Figure 5A:
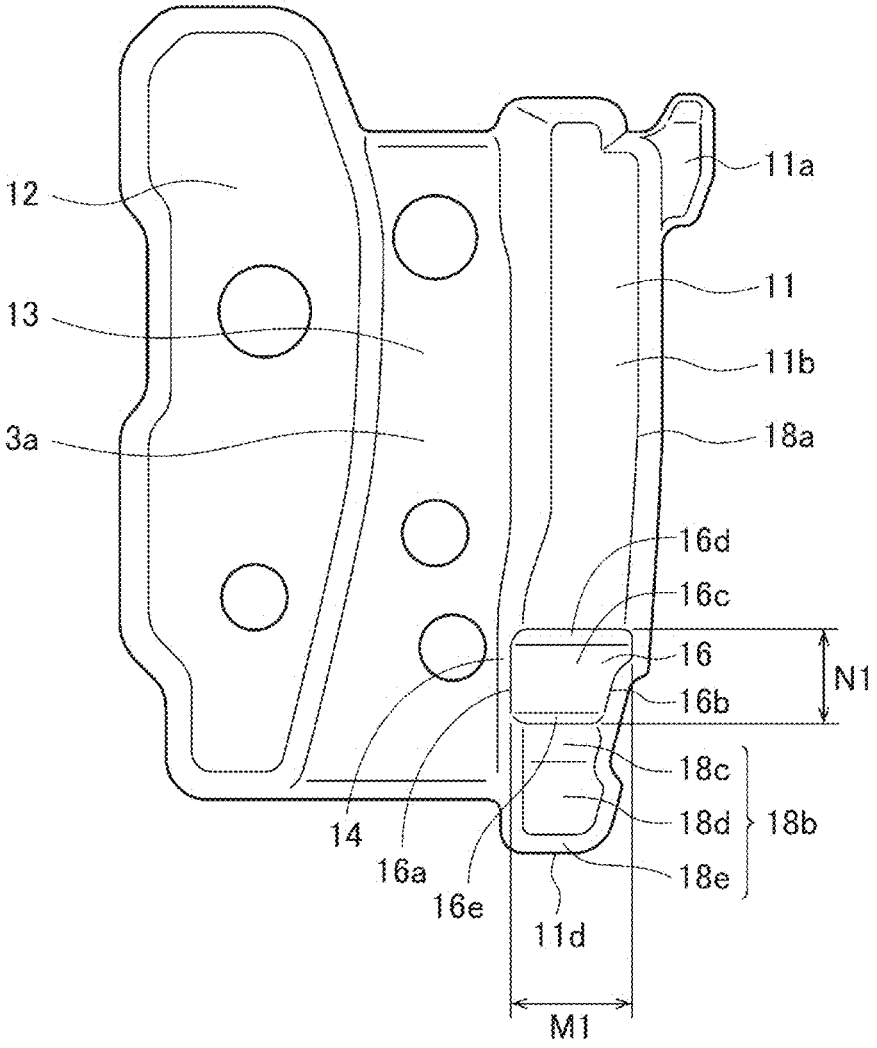
FIG. 5A is a front view of the first separating insert portion as viewed from a front surface side.
Figure 5B:
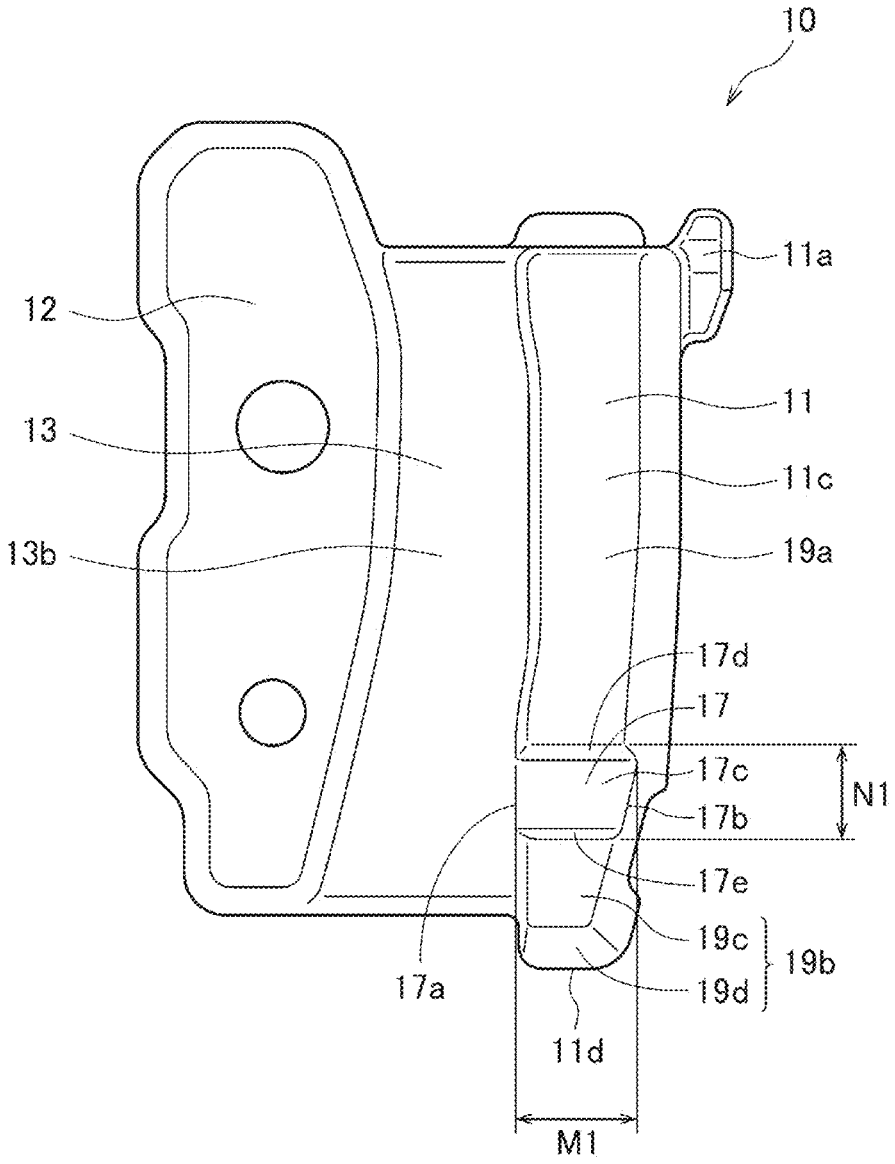
FIG. 5B is a rear view of the first separating insert portion as viewed from a back surface side.
Figure 5C:
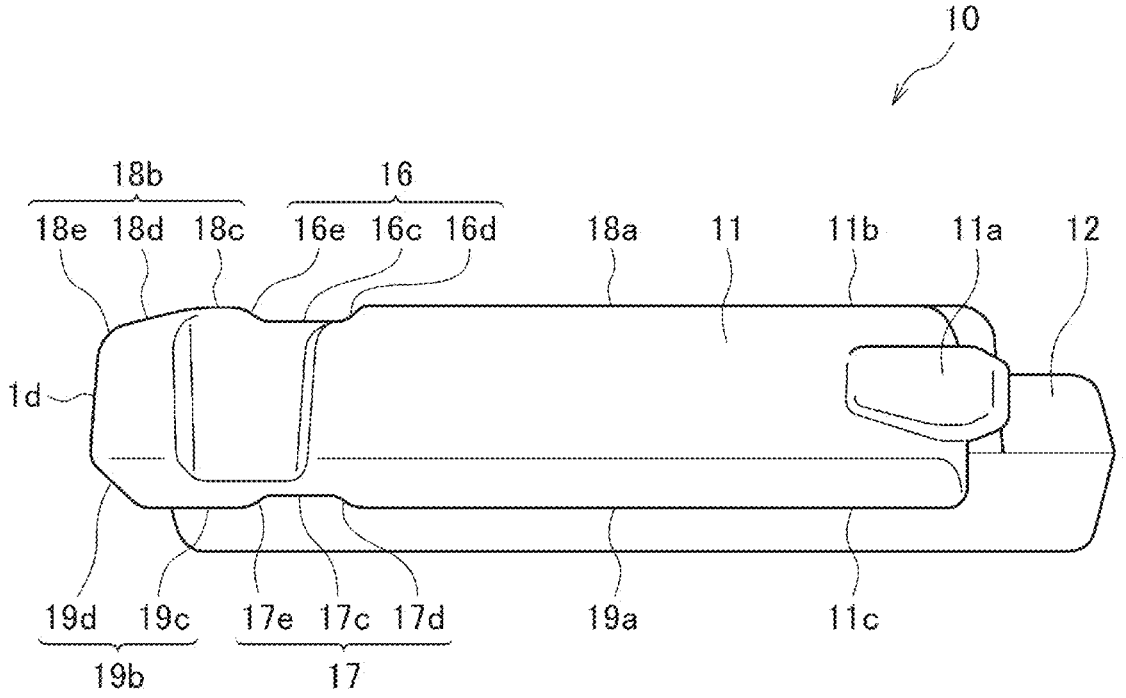
FIG. 5C is a right side view of the first separating insert portion as viewed from a width direction right side.

FIG. 4 is a perspective view of the first separating insert portion 10 and the second separating insert portion 20. FIG. 5A is a front view of the first separating insert portion 10 as viewed from a front surface side, FIG. 5B is a rear view of the first separating insert portion 10 as viewed from a back surface side, and FIG. 5C is a right side view of the first separating insert portion 10 as viewed from a width direction right side.

As shown in FIGS. 1 and 2 and FIGS. 4 to 5C, the first separating insert portion 10 includes a separable pin 11 that is long in the upper-lower direction and is provided on a width direction inner edge side of the lower end portion of the first stringer 30A, a first reinforcing strip portion 12 that is separated from the separable pin 11 leftward in the width direction and is provided substantially parallel to the separable pin 11 and is long in the upper-lower direction, and a first coupling portion 13 that couples the separable pin 11 and the first reinforcing strip portion 12 in the width direction.

In the front-back direction, a thickness of the separable pin 11 is slightly larger than a thickness of the first tape 31*a*. Therefore, a front surface 11*b* and a back surface 11*c* of the separable pin 11 is slightly raised from a front surface and a back surface of the first tape 31*a*. The degree of raise of the front surface 11*b* and the back surface 11*c* of the separable pin 11 from the front surface and the back surface of the tape 31 is the same as or slightly smaller than the degree of raise of the front surface and the back surface of the element 32 from the front surface and the back surface of the tapes 31*a*, 31*b*.

The separable pin 11 has a protrusion 11*a* protruding rightward from an upper right end portion. The protrusion 11*a* engages with a notch 21*c* of a retainer pin 21*b* to be described later.

The separable pin 11 is inserted into or removed from a separable pin hole 25 of a retainer 21 (to be described later) of the second separating insert portion 20, so that the first separating insert portion 10 is coupled to and discoupled from the second separating insert portion 20.

Recesses 16, 17 recessed in a direction in which a thickness of the separable pin 11 in the front-back direction is reduced are provided in lower portions of the front surface 11*b* and the back surface 11*c* of the separable pin 11, respectively. The recesses 16, 17 are located slightly above lower end portions of the front surface 11*b* and the back surface 11*c*. The recesses 16 and 17 are not necessarily provided on both the front surface 11*b* and the back surface 11*c* of the separable pin 11, and may be provided on at least one of the front surface 11*b* and the back surface 11*c*. Of the recesses 16, 17, the recess provided on the front surface 11*b* is referred to as a front side recess 16, and the recess provided on the back surface 11*c* is referred to as a back side recess 17.

The front side recess 16 includes an upper inclined surface 16*d* that is inclined to a back side as going toward a lower side from an upper end portion of the front side recess 16 in an insertion or removal direction (upper-lower direction) of the separable pin 11 and that increases a thickness of the front side recess 16, a lower inclined surface 16*e* that is inclined to a back side as going toward an upper side from a lower end portion of the front side recess 16 in the insertion or removal direction of the separable pin 11 and that increases the thickness of the front side recess 16, and a parallel surface 16*c* that connects the upper inclined surface 16*d* and the lower inclined surface 16*e* and that is parallel to the insertion or removal direction (upper-lower direction) and a width direction (left-right direction) of the separable pin 11.

The back side recess 17 includes an upper inclined surface 17*d* that is inclined to a front side as going toward the lower side from an upper end portion of the back side recess 17 in the insertion or removal direction (upper-lower direction) of the separable pin 11 and that increases a thickness of the back side recess 17, a lower inclined surface 17*e* that is inclined to a front side as going toward the upper side from a lower end portion of the back side recess 17 in the insertion or removal direction of the separable pin 11 and that increases the thickness of the back side recess 17, and a parallel surface 17*c* that connects the upper inclined surface 17*d* and the lower inclined surface 17*e* and that is parallel to the insertion or removal direction (upper-lower direction) and the width direction (left-right direction) of the separable pin 11.

The front side recess 16 and the back side recess 17 are formed over an entire length in the width direction of the front surface 11*b* and the back surface 11*c* of the separable pin 11. Therefore, the front side recess 16 and the back side recess 17 penetrate the separable pin 11 in the width direction, and have left openings 16*a*, 17*a* on a width direction left side and right openings 16*b*, 17*b* on a width direction right side, respectively. The parallel surface 16*c*, which is a bottom surface of the front side recess 16, is located on a front side of a front surface 13*a* of the first coupling portion 13 adjacent to the parallel surface 16*c* in the width direction. Therefore, a step 14 is formed between the parallel surface 16*c* of the front side recess 16 and the front surface 13*a* of the first coupling portion 13. On the other hand, the parallel surface 17*c*, which is a bottom surface of the back side recess 17, and the back surface 13*b* of the first coupling portion 13 adjacent in the width direction are smoothly connected and flush with each other, and both of the parallel surface 17*c* and the back surface 13*b* form the same plane.

Of the front surface 11*b* of the separable pin 11, a front surface upper portion 18*a* located above the front side recess 16 is a parallel surface parallel to the upper-lower direction and the width direction. Of the front surface 11*b* of the separable pin 11, a front surface lower portion 18*b* located below the front side recess 16 includes a parallel surface 18*c*, a first inclined surface 18*d*, and a second inclined surface 18*e*. The parallel surface 18*c* is connected to the lower end portion of the front side recess 16 and extends parallel to the upper-lower direction and the width direction. The first inclined surface 18*d* is connected to a lower end portion of the parallel surface 18*c* and is inclined toward the back surface 11*c* as going downward. The second inclined surface 18*e* connects a lower end portion of the first inclined surface 18*d* and a lower surface 11*d* of the separable pin 11, and is inclined toward the back surface 11*c* as going downward. The inclination of the second inclined surface 18*e* is larger than the inclination of the first inclined surface 18*d*.

Of the back surface 11*c* of the separable pin 11, a back surface upper portion 19*a* located above the back side recess 17 is a parallel surface parallel to the upper-lower direction and the width direction. Of the back surface 11*c* of the separable pin 11, a back surface lower portion 19*b* located below the back side recess 17 includes a parallel surface 19*c* and an inclined surface 19*d*. The parallel surface 19*c* is connected to the lower end portion of the back side recess 17 and extends parallel to the upper-lower direction and the width direction. The inclined surface 19*d* connects the lower end portion of the parallel surface 19*c* and the lower surface 11*d* of the separable pin 11, and is inclined toward the front surface 11*b* as going downward. The inclined surface 19*d* connects the lower end portion of the first inclined surface 18*d* and the lower surface 11*d* of the separable pin 11.

The first reinforcing strip portion 12 serves to reinforce the fixing of the separable pin 11 to the first tape 31*a* by being coupled to the separable pin 11 via the first coupling portion 13. An upper end of the first reinforcing strip portion 12 protrudes slightly above an upper end of the separable pin 11. A lower end of the separable pin 11 slightly protrudes downward from a lower end of the first reinforcing strip portion 12. A width in the left-right direction of the first reinforcing strip portion 12 is larger than a width in the left-right direction of the separable pin 11.

Prior to molding of the first separating insert portion 10 including the first reinforcing strip portion 12, a through hole (not shown) penetrating the first tape 31*a* in the front-back direction is provided in a portion of the left first tape 31*a* corresponding to the first reinforcing strip portion 12 or the first coupling portion 13, and the thermoplastic resin is connected between front and back surfaces of the first tape 31*a* through the through hole, so that the first reinforcing strip portion 12 and the first coupling portion 13 are firmly fixed to the front and back surfaces of the first tape 31*a*, and a peeling-off strength of the first reinforcing strip portion 12 and the first coupling portion 13 with respect to the first tape 31*a* is increased. Thus, since the first reinforcing strip portion 12 and the first coupling portion 13 are firmly fixed to the first tape 31*a*, the separable pin 11 is firmly fixed to the first tape 31*a*.

Figure 6A:
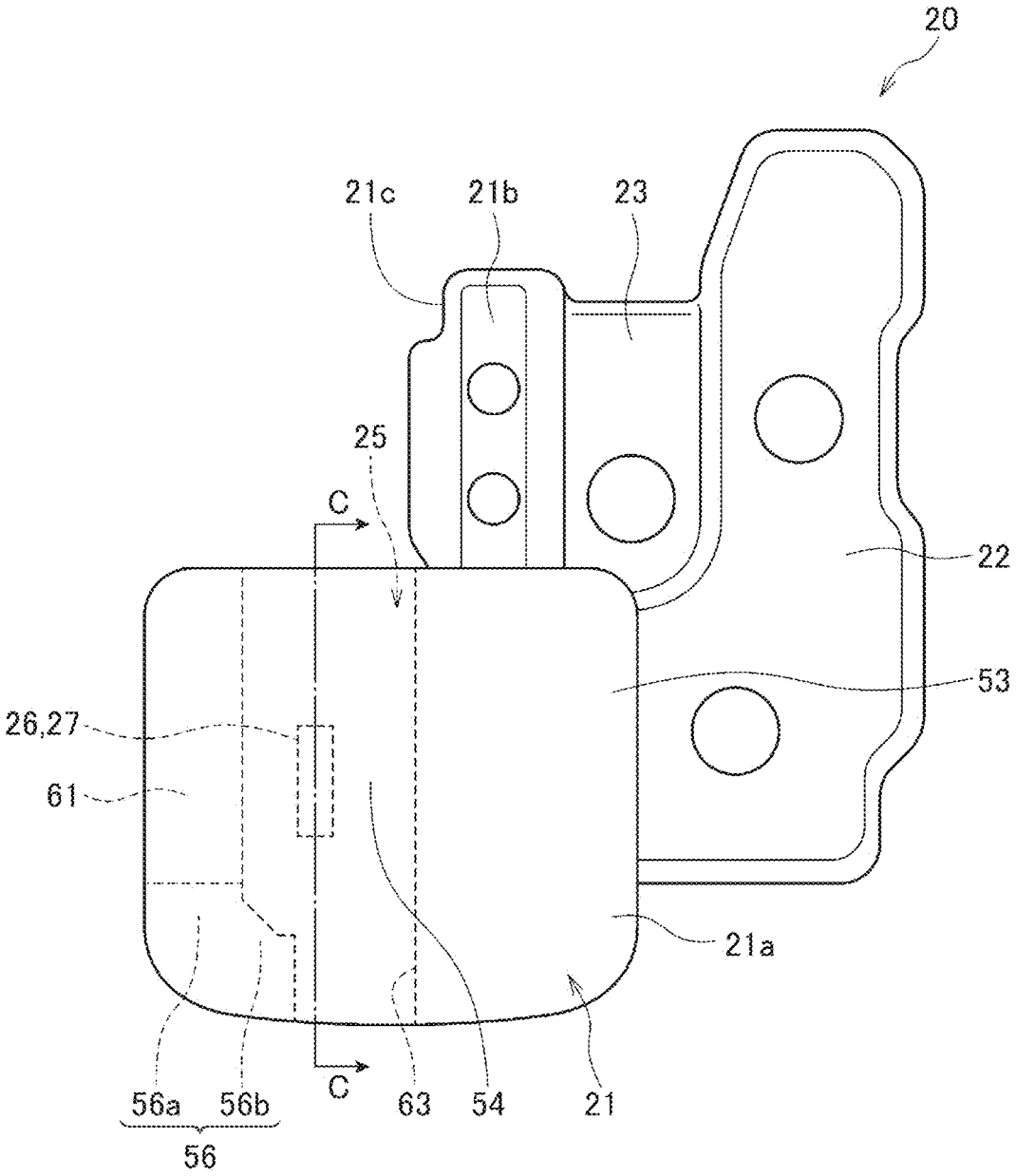
FIG. 6A is a front view of the second separating insert portion as viewed from the front surface side.
Figure 6B:
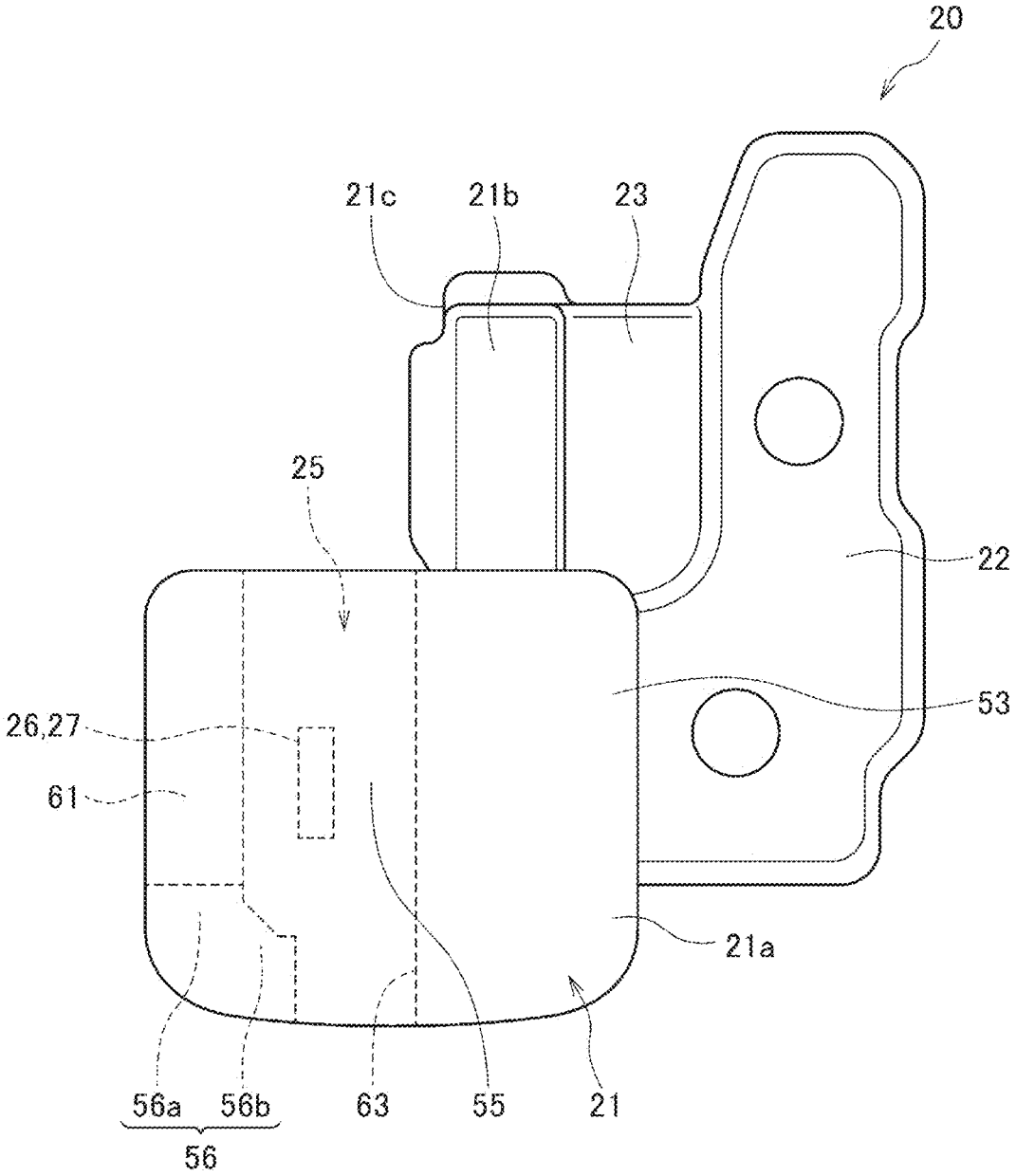
FIG. 6B is a rear view of the second separating insert portion as viewed from the back surface side.
Figure 6C:
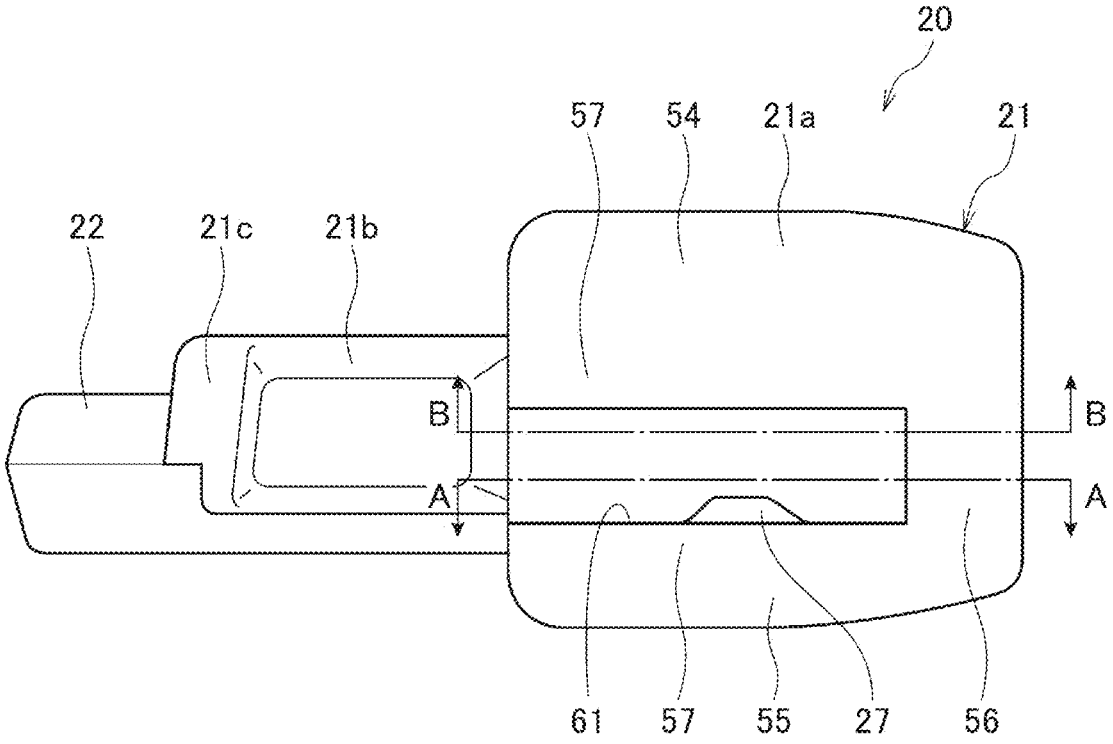
FIG. 6C is a left side view of the second separating insert portion as viewed from a width direction left side.
Figure 7A:
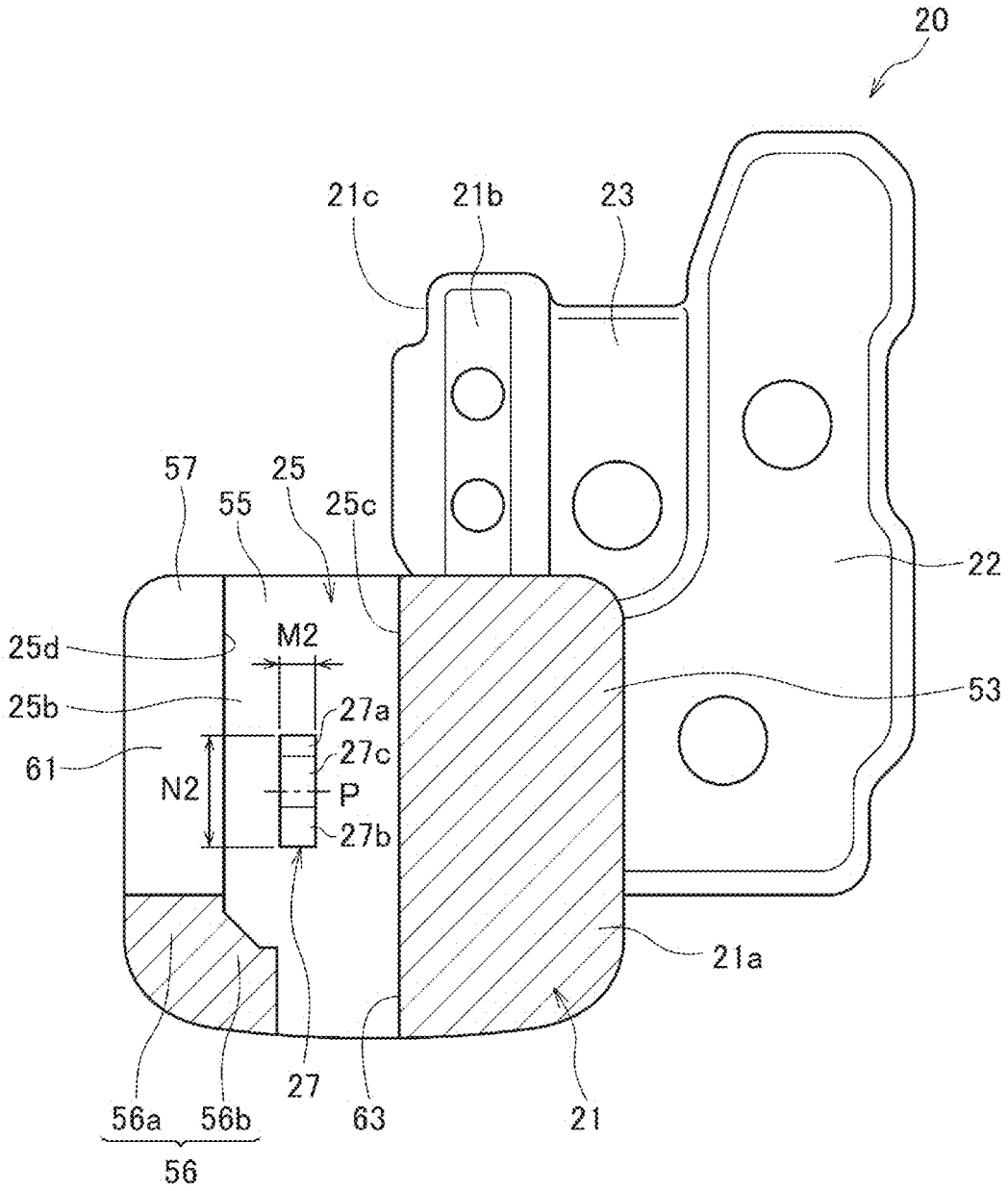
FIG. 7A is a front view of the second separating insert portion as viewed from the front surface side, and is a cross-sectional view of a retaining box taken along a line A-A in FIG. 6C.
Figure 7B:
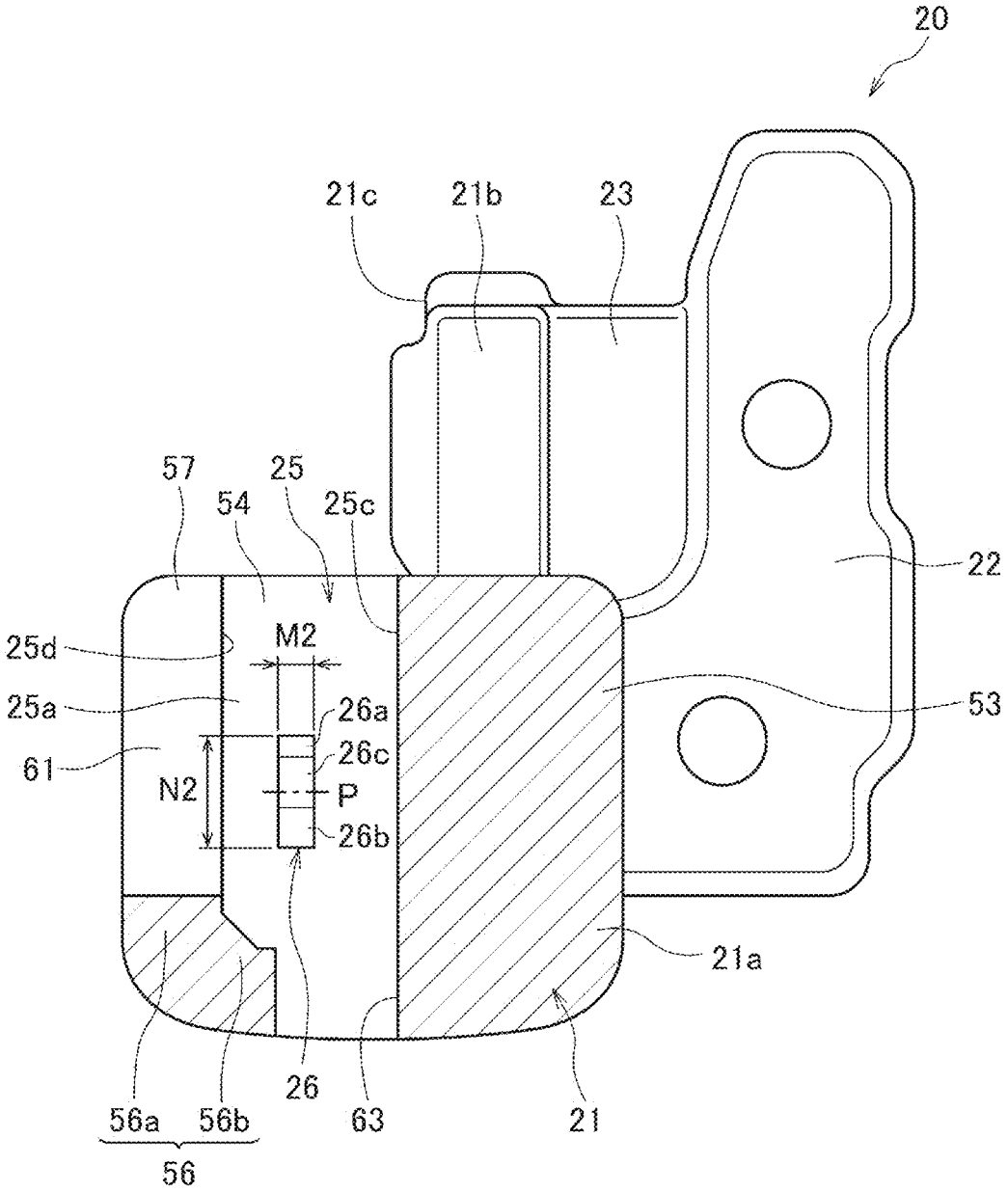
FIG. 7B is a rear view of the second separating insert portion as viewed from the back surface side, and is a cross-sectional view of the retaining box taken along a line B-B in FIG. 6C.
Figure 7C:
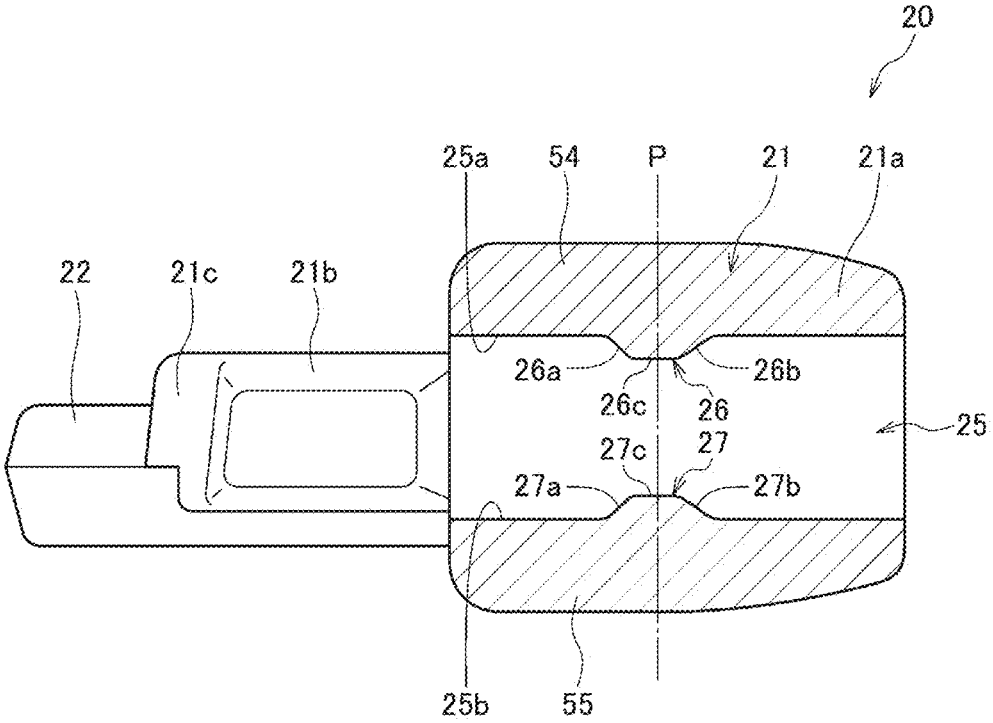
FIG. 7C is a left side view of the second separating insert portion as viewed from the width direction left side, and is a cross-sectional view of the retaining box taken along a line C-C in FIG. 6A.

FIG. 6A is a front view of the second separating insert portion 20 as viewed from the front surface side, FIG. 6B is a rear view of the second separating insert portion 20 as viewed from the back surface side, and FIG. 6C is a left side view of the second separating insert portion 20 as viewed from the width direction left side. FIG. 7A is a front view of the second separating insert portion 20 as viewed from the front surface side, and is a cross-sectional view of a retaining box 21*a* taken along a line A-A in FIG. 6C. FIG. 7B is a rear view of the second separating insert portion 20 as viewed from the back surface side, and is a cross-sectional view of the retaining box 21*a* taken along a line B-B in FIG. 6C. FIG. 7C is a left side view of the second separating insert portion 20 as viewed from the left side, and is a cross-sectional view of the retaining box 21*a* taken along a line C-C in FIG. 6A.

As shown in FIGS. 1 and 2 and FIGS. 6A to 7C, the second separating insert portion 20 includes a retainer 21 provided to cover the width direction inner edge side of the lower end portion of the second stringer 30B, a second reinforcing strip portion 22 that extends upward away from the right side surface of the retainer 21 to the right in the width direction, and a second coupling portion 23 that couples the retainer 21 and the second reinforcing strip portion 22.

The retainer 21 includes a retaining box 21*a* that has a separable pin hole 25 (see FIG. 4 and the like) in a left half portion into or from which the separable pin 11 can be inserted or removed in the upper-lower direction (longitudinal direction of the slide fastener 100), and a retainer pin 21*b* protruding upward from a right half portion of an upper surface of the retaining box 21*a*.

In the front-back direction, the retaining box 21*a* is formed thicker than the retainer pin 21*b* or the second reinforcing strip portion 22. In the front-back direction, the retainer pin 21*b* has the same thickness as the separable pin 11. When the separable pin 11 of the first separating insert portion 10 is inserted into the separable pin hole 25 of the retaining box 21*a* of the second separating insert portion, the first and second separating insert portions 10, 20 are in a coupling state (see FIG. 1), and the lower end portions of the first and second stringers 30A, 30B are in an alignment state. When the separable pin 11 is removed from the separable pin hole 25 of the retaining box 21*a*, the coupling between the first and second separating insert portions 10, 20 is released.

The retainer pin 21*b* is provided along the width direction inner edge side of the second stringer 30B and is integrally molded with the retaining box 21*a*. The retainer pin 21*b* has a notch 21*c* (see FIG. 2) at an upper left end portion that receives the protrusion 11*a* of the separable pin 11 in the coupling state where the retainer pin 21*b* is coupled to the first separating insert portion 10. In the coupling state of the first and second separating insert portions 10, 20, an upper end of the retainer pin 21*b* is located slightly below an upper end of the separable pin 11.

The second reinforcing strip portion 22 has substantially the same form as the first reinforcing strip portion 12 except for a base of the second reinforcing strip portion 22 coupled to the retainer 21, and has the same length in the upper-lower direction and thickness in the front-back direction as the first reinforcing strip portion 12.

The second reinforcing strip portion 22 or the second coupling portion 23 is provided with a through hole (not shown) penetrating the second tape 31*b* in the front-back direction in a portion of the right second tape 31*b* corresponding to the second reinforcing strip portion 22 or the second coupling portion 23 prior to injection molding of the second separating insert portion 20. Since the thermoplastic resin is connected between front and back surfaces of the second tape 31*b* through the through hole, the second reinforcing strip portion 22 and the second coupling portion 23 are firmly fixed to the front and back surfaces of the second tape 31*b*, and a peeling-off strength of the second reinforcing strip portion 22 and the second coupling portion 23 with respect to the second tape 31*b* is increased. Thus, since the second reinforcing strip portion 22 and the second coupling portion 23 are firmly fixed to the second tape 31*b*, the retainer 21 is firmly fixed to the second tape 31*b*.

As shown in FIG. 2, a region between the separable pin 11 and the first reinforcing strip portion 12 of the first separating insert portion 10 and above the retaining box 21*a* and a region between the retainer pin 21*b* and the second reinforcing strip portion 22 of the second separating insert portion 20 and above the retaining box 21*a* are thin guide portions 15, 24 having a relatively thin thickness with respect to the separable pin 11, the retainer pin 21*b*, and the first and second reinforcing strip portions 12 and 22 which are raised from the front and back surfaces of the tape 31. The slider 40 can move from the state of FIG. 1 to the lowest position where the slider 40 abuts against the retaining box 21*a*. When the slider 40 is lowered to the lowermost position, the raised portions 43*a*, 44*a* (see FIG. 3) on left and right side portions of the upper and lower blades 43, 44 of the slider 40 are guided to the thin guide portions 15, 24 of the first and second separating insert portions 10, 20. When the slider 40 is moved from the state of FIG. 1 to the lowest position where the slider 40 abuts against the separating insert 1, the separable pin 11 of the first separating insert portion 10 is removed from the retaining box 21*a*. When the separable pin 11 is further pulled upward through the element guide path between the upper blade 43 and the lower blade 44 of the slider 40, the coupling between the first separating insert portion 10 and the second separating insert portion 20 can be released, and the first stringer 30A and the second stringer 30B are separated. At this time, the slider 40 remains in the second stringer 30B.

The retainer 21 according to the first embodiment includes the retainer pin 21*b* arranged parallel to a right side (second tape 31*b* side) with respect to an upper portion of the separable pin 11 extending vertically, and the retaining box 21*a* including a separable pin hole 25 into or from which a lower portion of the separable pin 11 can be inserted or removed. The separable pin hole 25 is formed in a portion on an upper surface of the retaining box 21*a* on a left side (first tape 31*a* side). Similarly, the retainer pin 21*b* is joined to a portion on the upper surface of the retaining box 21*a* on a right side (second tape 31*b* side) in the left-right direction in a state of protruding upward.

The retaining box 21*a* is a hexagonal body including front, back, left, right, upper and lower surfaces. In the shown example, each surface is formed in a planar shape. The planar shape includes not only a plane but also a surface curved in an arc shape (surface bulging in an arc shape and surface recessed in an arc shape). For example, in the shown example, the front surface and the back surface are surfaces bulging in an arc shape (more specifically, surfaces that gradually bulge toward a front side from both ends of the entire width to the intermediate portion) among the surfaces curved in an arc shape. Furthermore, the retaining box 21*a* has a tape groove 61 into which the first tape 31*a* is inserted on a left side surface of the left and right side surfaces on the first tape 31*a* side. The tape groove 61 is a groove extending in the upper-lower direction to open the upper side and close a lower side. The separable pin hole 25 communicates with the second tape 31*b* side with respect to the tape groove 61, and the upper side of the separable pin hole 25 opens. On the other hand, in the lower side of the separable pin hole 25, the first tape 31*a* side is closed, and the second tape 31*b* side penetrates and a slide hole 63 is provided.

The retaining box 21*a* includes an upper-lower extension wall 53 that extends from a lower end portion of the retainer pin 21*b* to the lower side, a front side body wall 54 and a back side body wall 55 that protrude in parallel to the first tape 31*a* side in the left-right direction from both front and back end portions of the upper-lower extension wall 53, a joining wall 56 that joins end portions of the front side body wall 54 and the back side body wall 55 on the first tape 31*a* side at a lower end portion of the entire length in the upper-lower direction, and groove walls 57, 57 that protrude from end portions of the front side body wall 54 and the back side body wall 55 on the first tape 31*a* side so as to narrow a front and back interval formed between the front side body wall 54 and the back side body wall 55. A space formed between the pair of front and back groove walls 57, 57 serves as the tape groove 61. Each of the groove walls 57 in the shown example is formed over the entire range of the upper side of the joining wall 56 in the entire length of the front side body wall 54 and the back side body wall 55 in the upper-lower direction. Accordingly, the joining wall 56 is continuous with the lower side of the pair of front and back groove walls 57, 57. In addition, the retainer 21 according to the present embodiment has a front-back asymmetric shape, and the tape groove 61 is disposed at a back surface side with respect to a central portion in the front-back direction of the retainer 21 and is disposed closer to the back side body wall 55 than the front side body wall 54.

The upper-lower extension wall 53 has a rod shape having a rectangular cross section. Further, a left-right width of the upper-lower extension wall 53 is formed to be wider than that of the retainer pin 21*b* in the shown example. A surface on the first tape 31*a* side (surface on a separable pin hole 25 side) of the left and right side surfaces of the upper-lower extension wall 53 is formed to be substantially flush with the corresponding surface of the retainer pin 21*b*, and a surface on the second tape 31*b* side of the left and right side surfaces of the upper-lower extension wall 53 protrudes to a right side of the retainer pin 21*b*. An upper-lower width of the upper-lower extension wall 53 is the same as an upper-lower width of the retainer pin 21*b*. The front side body wall 54 and the back side body wall 55 that protrude from both the front and back ends of the upper-lower extension wall 53 to the width direction (first tape 31*a* side) are both plate-shaped.

The joining wall 56 includes a groove closing portion 56*a* that closes a lower side of the tape groove 61 and a hole closing portion 56*b* that closes the first tape 31*a* side located below the separable pin hole 25. Therefore, a space surrounded by the joining wall 56 (hole closing portion 56*b*), the upper-lower extension wall 53, the front side body wall 54, and the back side body wall 55 serves as the slide hole 63 into which a first slide 7 (see FIG. 15) for resin molding to be described later is inserted, and the slide hole 63 communicates with the separable pin hole 25.

Inner surfaces forming the separable pin hole 25 of the retainer 21 includes a front side surface 25*a* formed by a back surface of the front side body wall 54 and facing the front surface 11*b* of the separable pin 11, a back side surface 25*b* formed by a front surface of the back side body wall 55 and facing the back surface 11*c* of the separable pin 11, a right side surface 25*c* formed by a side surface (left side surface) of the upper-lower extension wall 53 on the first tape 31*a* side and facing a side surface (right side surface) of the separable pin 11 on the second tape 31*b* side, and a pair of left side surfaces 25*d*, 25*d* formed by side surfaces (right side surfaces) of the pair of front and back groove walls 57, 57 on the second tape 31*b* side and facing the side surfaces (left side surface) of the separable pin on the first tape 31*a* side. Since the tape groove 61 is interposed between the pair of left side surfaces 25*d*, 25*d* in the front-back direction, the pair of left side surfaces 25*d*, 25*d* are separated from each other in the front-back direction.

Among the inner surfaces forming the separable pin hole 25 of the retainer 21, the front side surface 25*a* and the back side surface 25*b* facing the front surface 11*b* and the back surface 11*c* of the separable pin 11 are respectively provided with convex portions 26, 27 that can be engaged with the front side recess 16 and the back side recess 17 of the separable pin 11. The convex portions 26, 27 are not necessarily provided on both the front side surface 25*a* and the back side surface 25*b*, and may be provided on at least one of the front side surface 25*a* and the back side surface 25*b*. Of the convex portions 26, 27, the convex portion provided on the front side surface 25*a* (back wall of the front side body wall 54) is referred to as a front side convex portion 26, and the convex portion provided on the back side surface 25*b* is referred to as a back side convex portion 27.

As shown in FIG. 7A, FIG. 7B, and FIG. 7C, the front side convex portion 26 and the back side convex portion 27 have a non-symmetrical shape with respect to a plane P passing through a central portion of the front side convex portion 26 and the back side convex portion 27 in the insertion or removal direction (upper-lower direction) of the separable pin 11 and perpendicular to the insertion or removal direction.

More specifically, the front side convex portion 26 includes an upper inclined surface 26*a* that is inclined to the back side as going toward the lower side from an upper end portion of the front side convex portion 26 in the insertion or removal direction (upper-lower direction) of the separable pin 11 to increase a thickness of the front side convex portion 26, and a lower inclined surface 26*b* that is inclined to the back side as going toward the upper side from a lower end portion of the front side convex portion 26 in the insertion or removal direction of the separable pin 11 to increase the thickness of the front side convex portion 26. The inclination of the upper inclined surface 26*a* is larger than the inclination of the lower inclined surface 26*b*.

In addition, the back side convex portion 27 includes an upper inclined surface 27*a* that is inclined to the front side as going toward the lower side from an upper end portion of the back side convex portion 27 in the insertion or removal direction (upper-lower direction) of the separable pin 11 to increase a thickness of the back side convex portion 27, and a lower inclined surface 27*b* that is inclined to the front side as going toward the upper side from a lower end portion of the back side convex portion 27 in the insertion or removal direction of the separable pin 11 to increase the thickness of the back side convex portion 27. The inclination of the upper inclined surface 27*a* is larger than the inclination of the lower inclined surface 27*b*.

As described above, the inclination of the upper inclined surfaces 26*a*, 27*a* that are brought into contact with the separable pin when the separable pin 11 is inserted into the separable pin hole 25 is relatively steep, and the inclination of the lower inclined surfaces 26*b*, 27*b* that are brought into contact with the separable pin when the separable pin 11 is removed from the separable pin hole 25 is relatively gently set. Therefore, as described later, a force Fin required to insert the separable pin 11 into the separable pin hole 25 is made larger than a force Fout required to remove the separable pin 11 from the separable pin hole 25.

The front side convex portion 26 and the back side convex portion 27 respectively include parallel surfaces 26*c*, 27*c* that connect the upper inclined surfaces 26*a*, 27*a* and the lower inclined surfaces 26*b*, 27 and are parallel to the insertion or removal direction (upper-lower direction) and the width direction (left-right direction) of the separable pin 11. These parallel surfaces 26*c*, 27*c* are located to intersect with the plane P.

As described above, while the front side recess 16 and the back side recess 17 of the separable pin 11 are formed over the entire length in the width direction of the separable pin 11, the front side convex portion 26 and the back side convex portion 27 of the retainer 21 are formed over a part of the length in the width direction of the separable pin hole 25, rather than over the entire width direction of the separable pin hole 25. A length M1 (see FIGS. 5A and 5B) of the front side recess 16 and the back side recess 17 in the width direction is larger than a length M2 (see FIGS. 7A and 7B) of the front side convex portion 26 and the back side convex portion 27 in the width direction (M1>M2). A length N1 (see FIGS. 5A and 5B) in the upper-lower direction of the front side recess 16 and the back side recess 17 is substantially equal to a length N2 (see FIGS. 7A and 7B) in the upper-lower direction of the front side convex portion 26 and the back side convex portion 27 (N1=N2).

Figure 8:
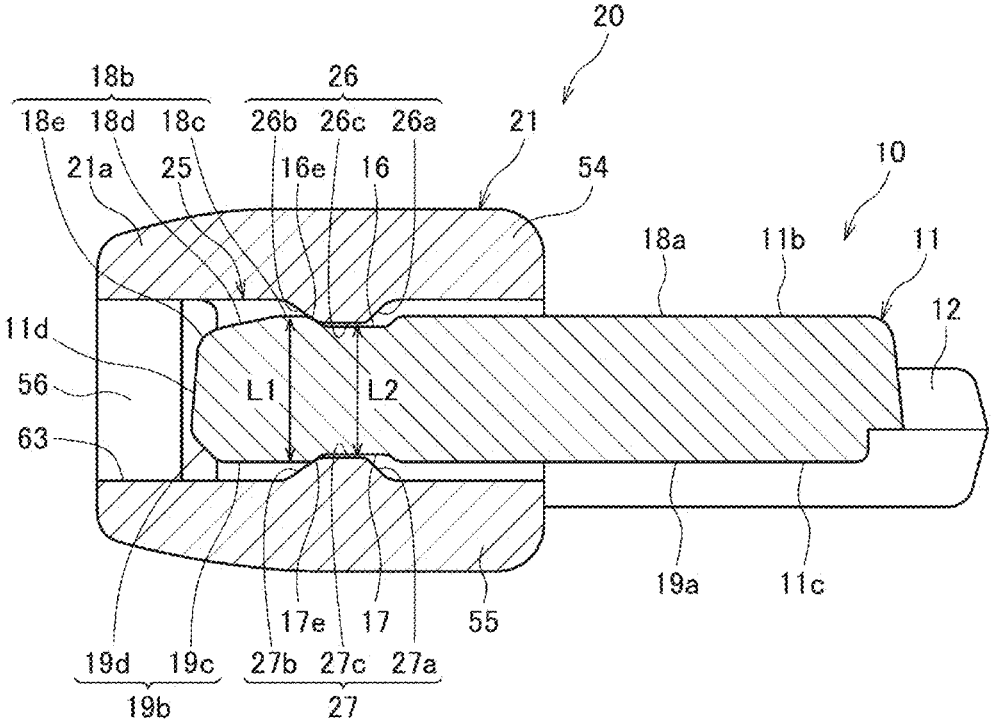
FIG. 8 is a partial cross-sectional view showing a state where a separable pin is inserted into a separable pin hole of a retainer as viewed from the width direction.

FIG. 8 is a partial cross-sectional view showing a state where the separable pin 11 is inserted into the separable pin hole 25 of the retainer 21 as viewed from the width direction. In FIG. 8, the retaining box 21*a* of the retainer 21 is shown, while the retainer pin 21*b* is not shown. As shown in FIG. 8, in a state where the separable pin 11 is completely inserted into the separable pin hole 25 of the retainer 21, the front side convex portion 26 and the back side convex portion 27 of the retainer 21 are engaged with the front side recess 16 and the back side recess 17 of the separable pin 11, so that the separable pin 11 is prevented from coming out of the retainer 21. Therefore, the separable pin 11 is not displaced after the separable pin 11 is assembled into the retainer 21, so that the element misassembly is unlikely to occur, and the slider 40 is easily pulled up.

Here, on a lower side of the front side recess 16 and the back side recess 17 of the separable pin 11, a portion having the largest dimension in the front-back direction is a portion between a pair of front and back parallel surfaces 18*c*, 19*c*, and a dimension in the front-back direction of the portion is L1. A portion of the separable pin hole 25 having the smallest dimension in the front-back direction is a portion between parallel surfaces 26*c*, 27*c* of the pair of front and back convex portions 26, 27, and a dimension of the portion in the front-back direction is L2. Since the magnitude relation between the dimensions L1 and L2 is L1>L2, when the separable pin 11 is inserted into the separable pin hole 25 from above (right side in FIG. 8), a lower end portion (left end portion in FIG. 8) of the separable pin 11 interferes with the pair of front and back convex portions 26, 27 of the separable pin hole 25. L1 is preferably set such that a gap with respect to the separable pin hole 25 is small in order to prevent rattling when the separable pin 11 is inserted.

More specifically, when the separable pin 11 is inserted into the separable pin hole 25, the first and second inclined surfaces 18*d*, 18*e* on a front side and the inclined surface 19*d* on a back side of the separable pin 11 come into contact with the upper inclined surfaces 26*a*, 27*a* of the pair of front and back convex portions 26, 27.

By providing a plurality of inclined surfaces 26*a*, 27*a*, 18*d*, 18*e*, 19*d* on the retainer 21 and the separable pin 11, the separable pin 11 is smoothly guided between the pair of front and back convex portions 26, 27. The front and back parallel surfaces 18*c*, 19*c* of the separable pin 11 come into contact with the upper inclined surfaces 26*a*, 27*a* and the parallel surfaces 26*c*, 27*c* of the convex portions 26, 27, and the separable pin 11 rides over the convex portions 26, 27 while pushing the retainer 21 outward in the front-back direction, whereby the front side recess 16 and the back side recess 17 of the separable pin 11 are engaged with the front side convex portion 26 and the back side convex portion 27 of the retainer 21.

Here, as described above, the inclination of the upper inclined surfaces 26*a*, 27*a* is larger than the inclination of the lower inclined surfaces 26*b*, 27*b*, and the inclination of the upper inclined surfaces 26*a*, 27*a* that are brought into contact with the separable pin when the separable pin 11 is inserted into the separable pin hole 25 is relatively steep. Therefore, the force Fin required to insert the separable pin 11 into the separable pin hole 25, that is, a force required for the separable pin 11 to ride over and engage with the convex portions 26, 27, is set to be relatively large. Specifically, Fin is set to 4 N to 6 N. A method for measuring Fin will be described later.

Therefore, a relatively large force is required to completely insert the separable pin 11 into the separable pin hole 25, so that the user can get an insertion feeling or a click feeling that the separable pin 11 is fitted into the retainer 21, and can appropriately recognize that the separable pin 11 is completely inserted into the retainer 21 due to resistance feeling and a sound when the separable pin 11 rides over the convex portions 26, 27.

In particular, in the present embodiment, the recesses 16, 17 are respectively provided on the front surface 11*b* and the back surface 11*c* of the separable pin 11, and the convex portions 26, 27 are respectively provided on the front side surface 25*a* and the back side surface 25*b* of the separable pin hole 25. Therefore, the force Fin required to engage the convex portions 26, 27 with the recesses 16, 17 becomes larger, allowing the user to more reliably get an insertion feeling or click feeling that the separable pin 11 is fitted into the retainer 21, and to more appropriately recognize that the separable pin 11 is completely inserted into the retainer 21. When positions of the recess 16 and the recess 17 in the insertion or removal direction are separated from each other, the engagement of the recess 16 and the engagement of the recess 17 are shifted from each other, so that it is preferable that the positions of the recess 16 and the recess 17 in the insertion or removal direction are the same or close to each other. The same applies to the convex portions 26, 27 corresponding thereto.

Further, since the convex portions 26, 27 include the parallel surfaces 26*c*, 27*c* that smoothly connect the upper inclined surfaces 26*a*, 27*a* and the lower inclined surfaces 26*b*, 27*b* and are parallel to the insertion or removal direction (upper-lower direction) and the width direction (left-right direction) of the separable pin 11, the convex portions 26, 27 and the recesses 16, 17 can be engaged with little rattling.

The recesses 16, 17 penetrate the separable pin 11 in the width direction and have the left openings 16*a*, 17*a* and the right openings 16*b*, 17*b* (see FIGS. 5A and 5B). Accordingly, even if dust such as human dirt or clothes fiber enters the recesses 16, 17, the dust can be easily discharged from the left openings 16*a*, 17*a* and the right openings 16*b*, 17*b*. If dust as described above is accumulated in the recesses 16, 17, the user cannot appropriately get an insertion feeling when the separable pin 11 is inserted into the separable pin hole 25, which is not preferable.

As described above, since the length M1 (see FIGS. 5A and 5B) of the recesses 16, 17 in the width direction is set to be larger than the length M2 (see FIGS. 7A and 7B) of the convex portions 26, 27 in the width direction, the convex portions 26, 27 are easily fitted into the recesses 16, 17. For example, the separable pin 11 may be inserted while being inclined in the width direction (left-right direction) with respect to the separable pin hole 25. Even in this case, the recesses 16, 17 of the separable pin are also securely engaged with the convex portions 26, 27 of the separable pin hole 25. Further, even when the convex portions 26, 27 come into contact with the recesses 16, 17 after the engagement, the convex portions 26, 27 are elastically deformed in the width direction in the recesses 16, 17, so that local stress can be prevented from being generated in the convex portions 26, 27.

Further, when the recesses 16, 17 are engaged with the convex portions 26, 27, a gap between the recesses 16, 17 and the convex portions 26, 27 in the width direction (left-right direction) is larger than a gap between the recesses 16, 17 and the convex portions 26, 27 in the insertion or removal direction (upper-lower direction) of the separable pin 11. With this configuration, when the recesses 16, 17 and the convex portions 26, 27 are engaged with each other, an insertion feeling that the recesses 16, 17 are fitted into the convex portions 26, 27 can be obtained, and the convex portions 26, 27 can be easily fitted into the recesses 16, 17. The former gap in the width direction is a difference M1−M2 between the length M1 (see FIGS. 5A and 5B) in the width direction of the recesses 16, 17 and the length M2 (see FIGS. 7A and 7B) in the width direction of the convex portion 26, 27, and is relatively large. The latter gap in the upper-lower direction is a difference N1−N2 between the length N1 (see FIGS. 5A and 5B) in the upper-lower direction of the recesses 16, 17 and the length N2 (see FIGS. 7A and 7B) in the upper-lower direction of the convex portions 26, 27, and is zero or very small.

When the separable pin 11 is removed upward (rightward in FIG. 8) from the state of FIG. 8, the lower end portion (left end portion in FIG. 8) of the separable pin 11 interferes with the pair of front and back convex portions 26, 27 of the separable pin hole 25 as in the case of insertion.

More specifically, when the separable pin 11 is removed from the separable pin hole 25, the lower inclined surfaces 16*e*, 17*e* of the front and back recesses 16, 17 of the separable pin 11 come into contact with the lower inclined surfaces 26*b*, 27*b* of the pair of front and back convex portions 26, 27. By providing a plurality of inclined surfaces 26*b*, 27*b*, 16*e*, 17*e* on the retainer 21 and the separable pin 11, the separable pin 11 is smoothly guided between the pair of front and back convex portions 26, 27. The front and back parallel surfaces 18*c*, 19*c* of the separable pin 11 come into contact with the lower inclined surfaces 26*b*, 27*b* and the parallel surfaces 26*c*, 27*c* of the convex portions 26, 27, and the separable pin 11 rides over the convex portions 26, 27 while pushing the retainer 21 outward in the front-back direction, whereby the engagement between the front side recess 16 and the back side recess 17 of the separable pin 11 and the front side convex portion 26 and the back side convex portion 27 of the retainer 21 is released.

Here, as described above, the inclination of the lower inclined surfaces 26*b*, 27*b* is smaller than the inclination of the upper inclined surfaces 26*a*, 27*a*, and the inclination of the lower inclined surfaces 26*b*, 27*b* that are brought into contact with the separable pin when the separable pin 11 is removed from the separable pin hole 25 is relatively gentle. Therefore, the force Fout required to remove the separable pin 11 from the separable pin hole 25, that is, a force required for the separable pin 11 to ride over the convex portions 26, 27 and release the engagement, is set to be relatively small. Specifically, Fout is set to be smaller than Fin. A method for measuring Fout will be described later.

Second Embodiment

In the first embodiment, an example has been described in which the first reinforcing strip portion 12 and the first coupling portion 13 are provided in the first separating insert portion 10 and the second reinforcing strip portion 22 and the second coupling portion 23 are provided in the second separating insert portion 20, but as in a second embodiment to be described below, the first separating insert portion 10 may not include the first reinforcing strip portion 12 and the first coupling portion 13, and the second separating insert portion 20 may not include the second reinforcing strip portion 22 and the second coupling portion 23.

Figure 9:
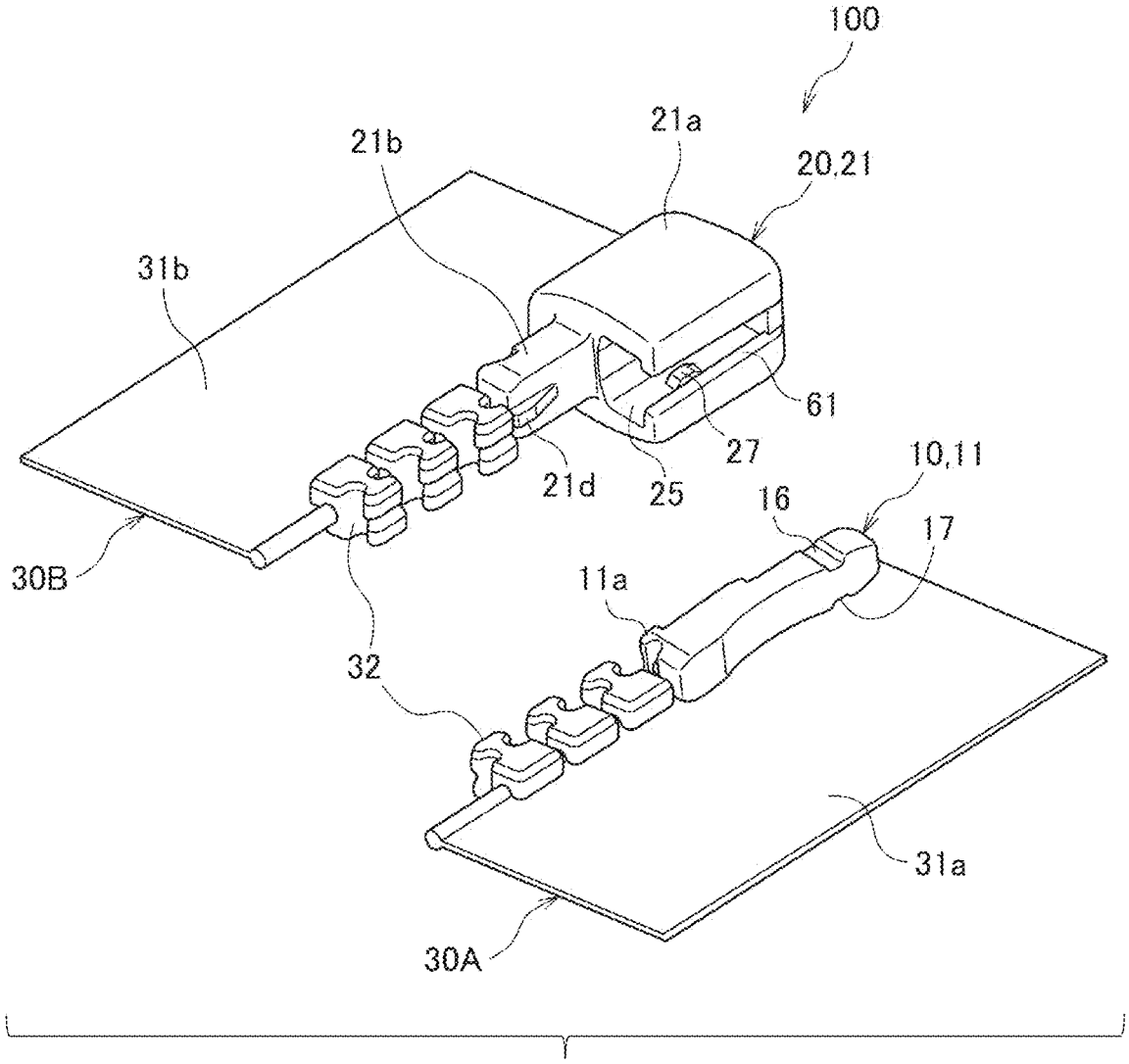
FIG. 9 is an enlarged perspective view showing a decoupling state of first and second separating insert portions in a slide fastener according to a second embodiment.
Figure 10:
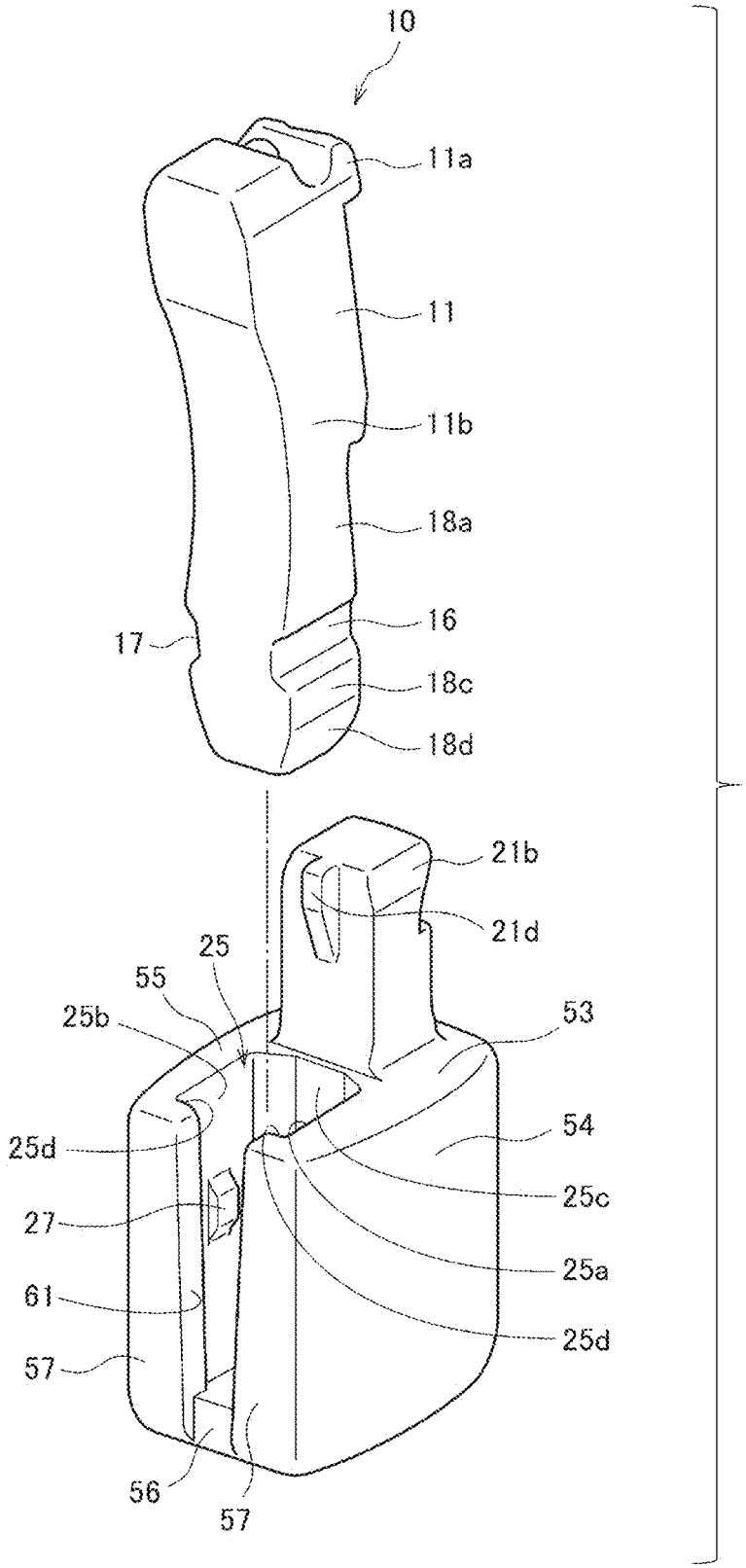
FIG. 10 is a perspective view of the first separating insert portion and the second separating insert portion.
Figure 11A:
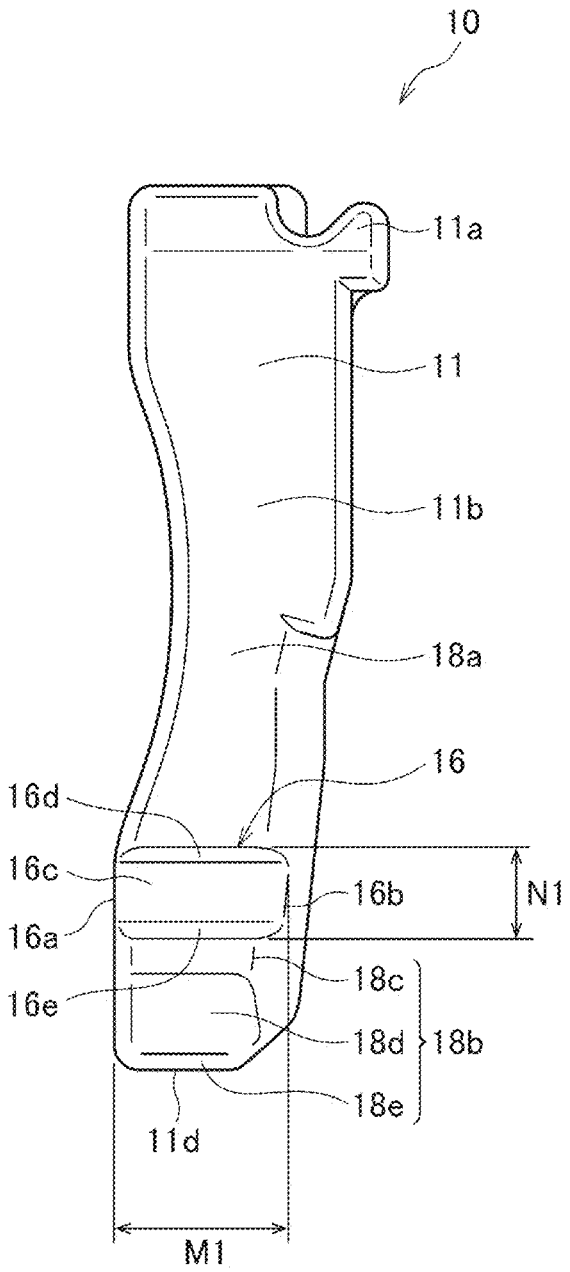
FIG. 11A is a front view of the first separating insert portion as viewed from the front surface side.
Figure 11B:
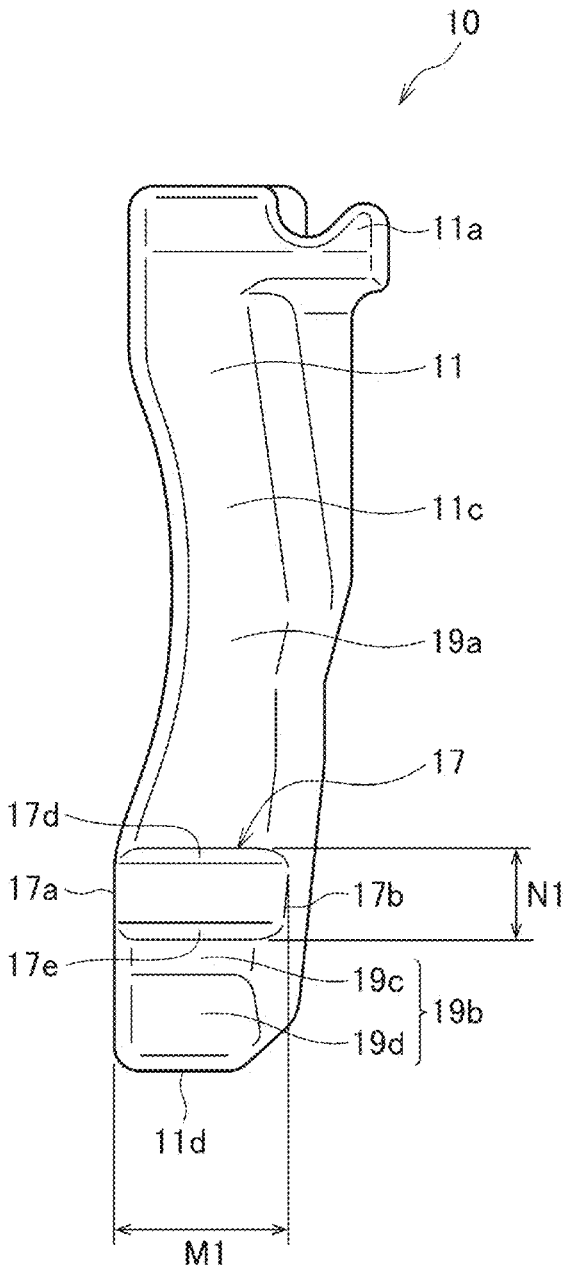
FIG. 11B is a rear view of the first separating insert portion as viewed from the back surface side.
Figure 11C:
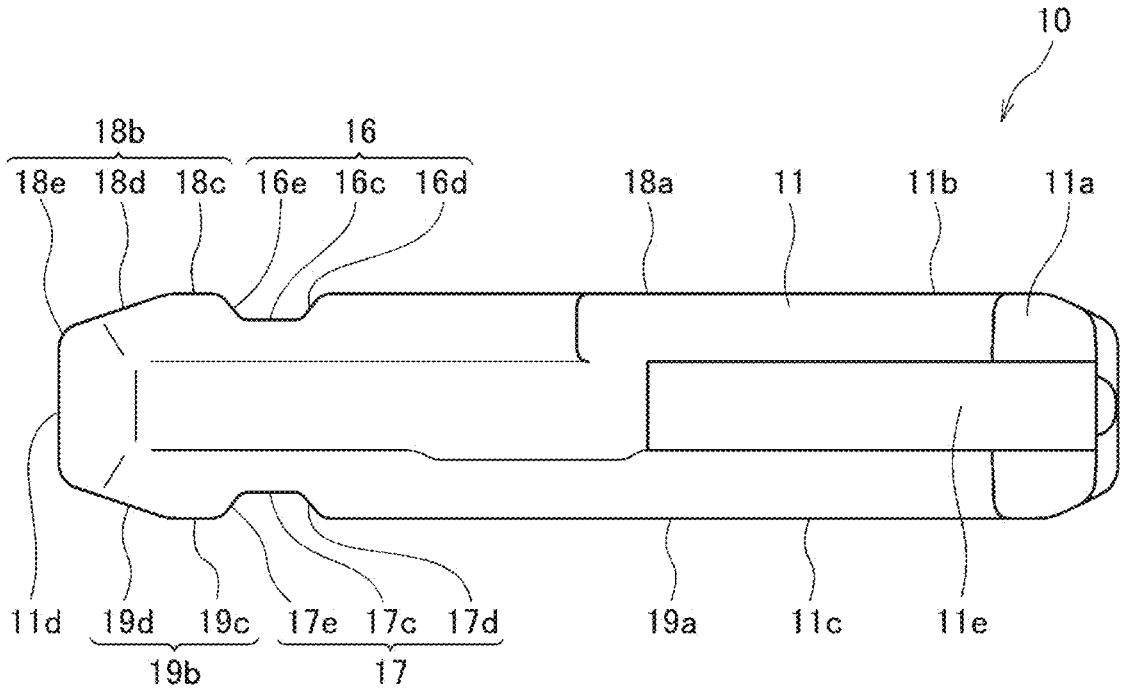
FIG. 11C is a right side view of the first separating insert portion as viewed from the width direction right side.
Figure 12A:
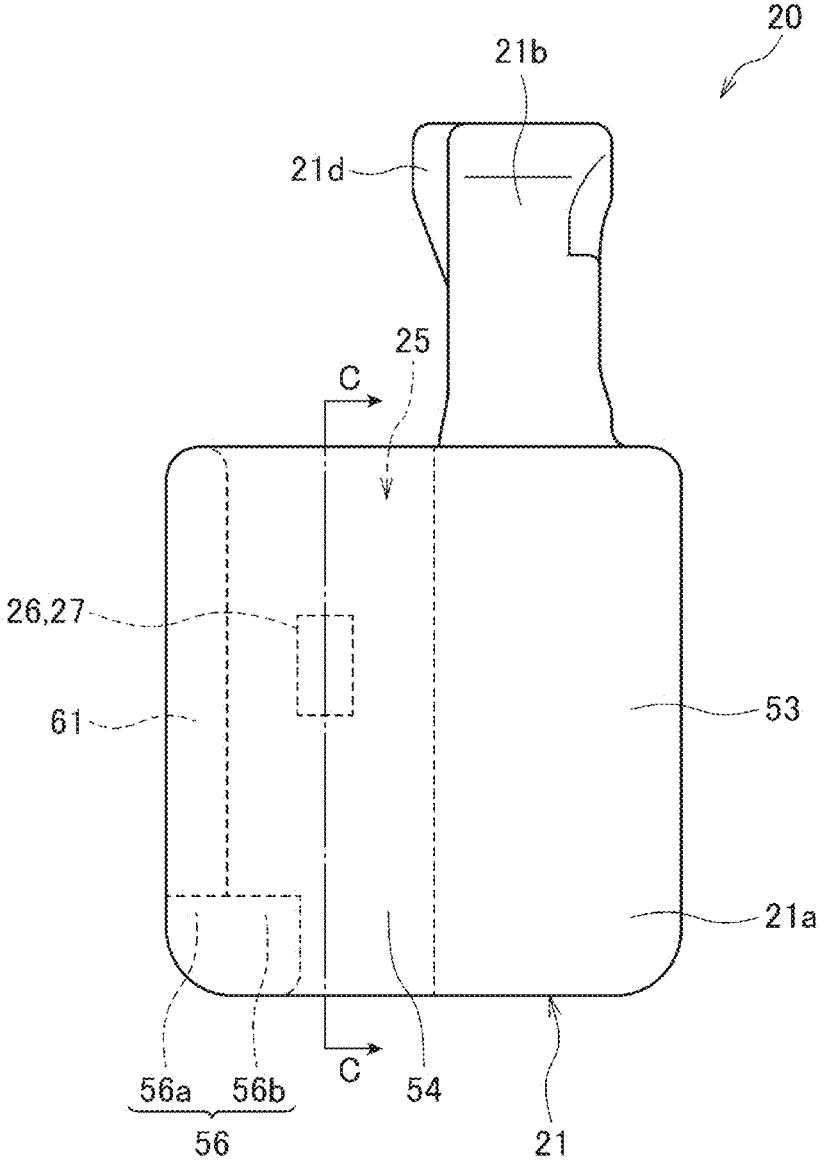
FIG. 12A is a front view of the second separating insert portion as viewed from the front surface side.
Figure 12B:
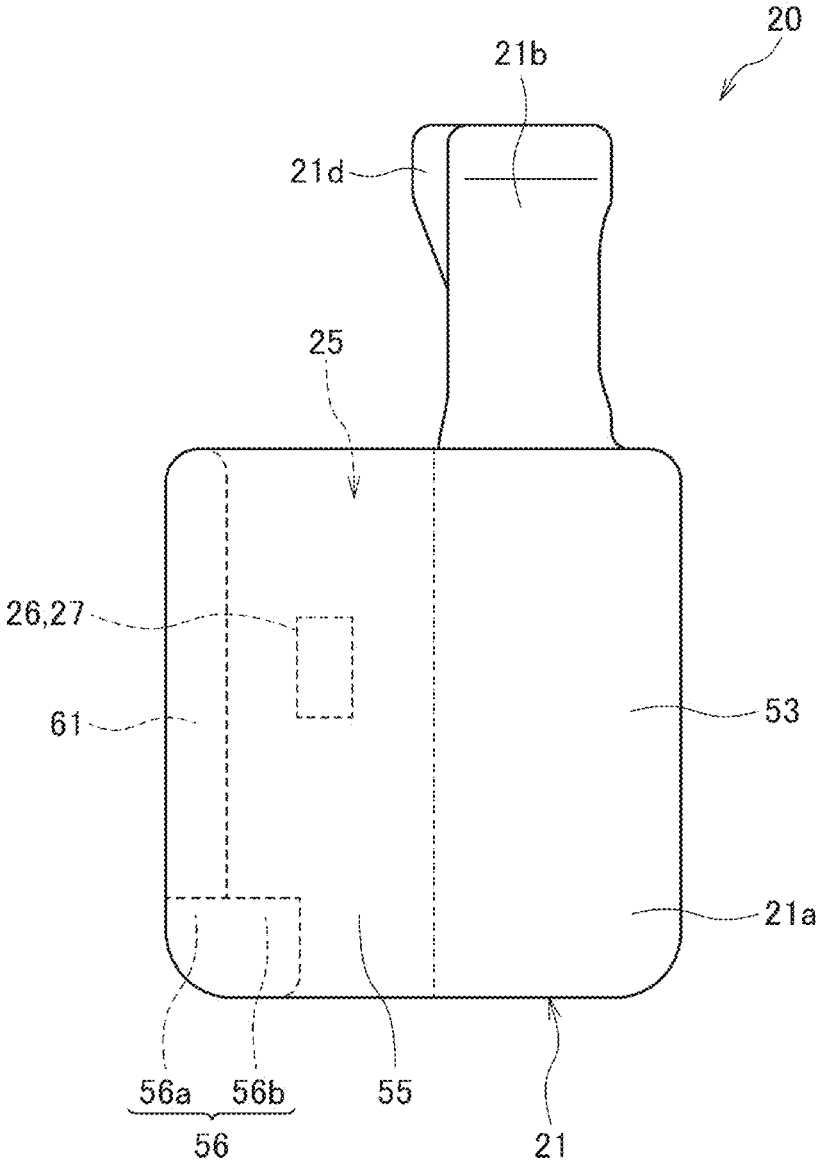
FIG. 12B is a rear view of the second separating insert portion as viewed from the back surface side.
Figure 12C:
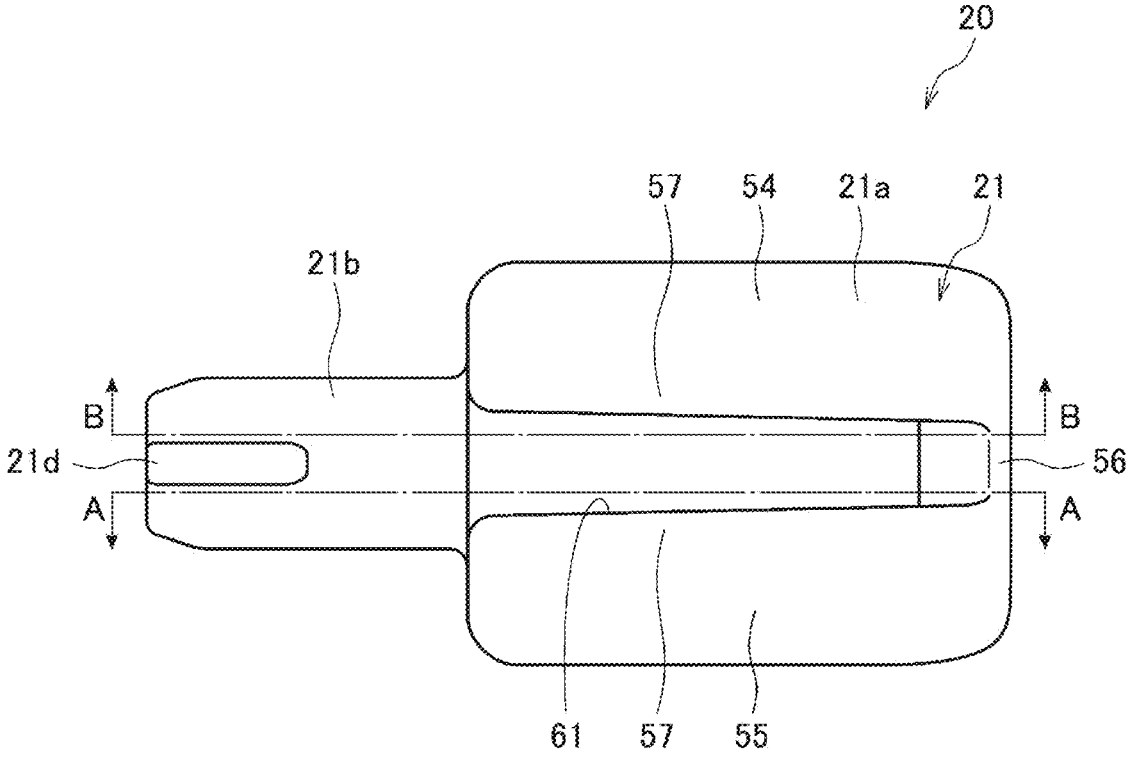
FIG. 12C is a left side view of the second separating insert portion as viewed from the width direction left side.
Figure 13A:
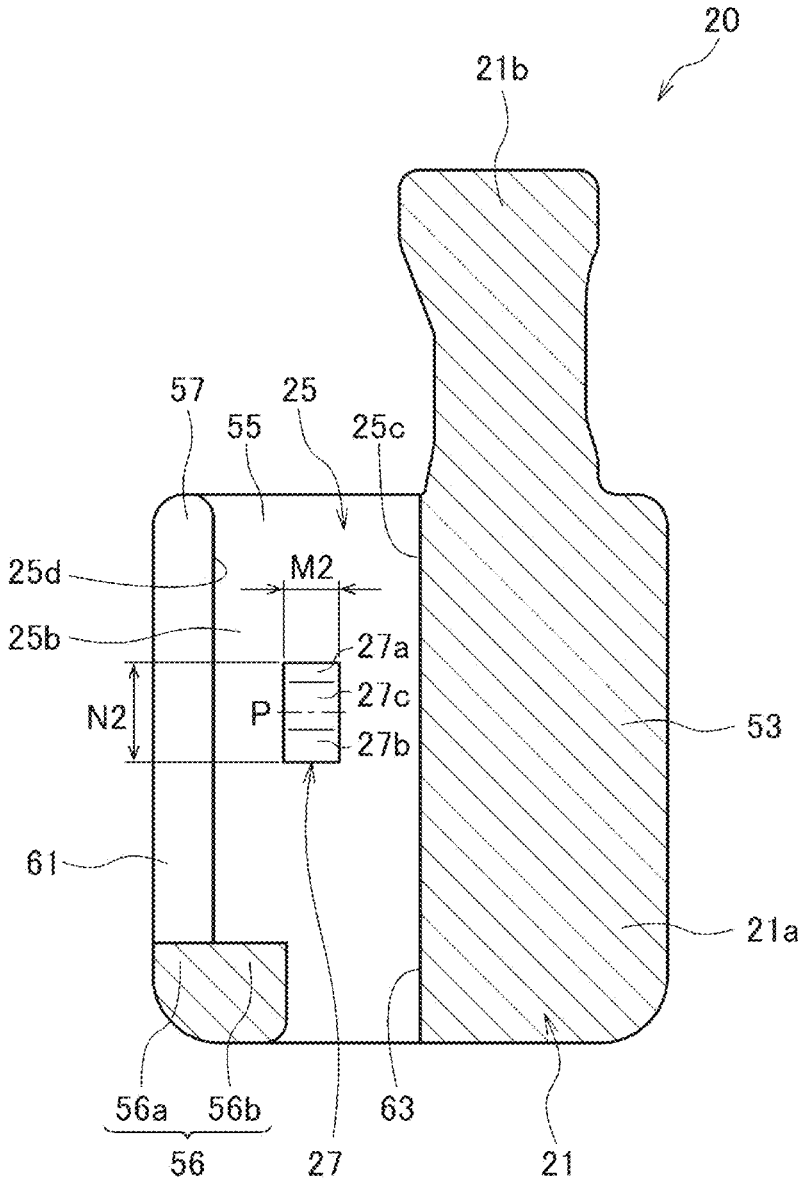
FIG. 13A is a front view of the second separating insert portion as viewed from the front surface side, and is a cross-sectional view of a retainer taken along a line A-A in FIG. 12C.
Figure 13B:
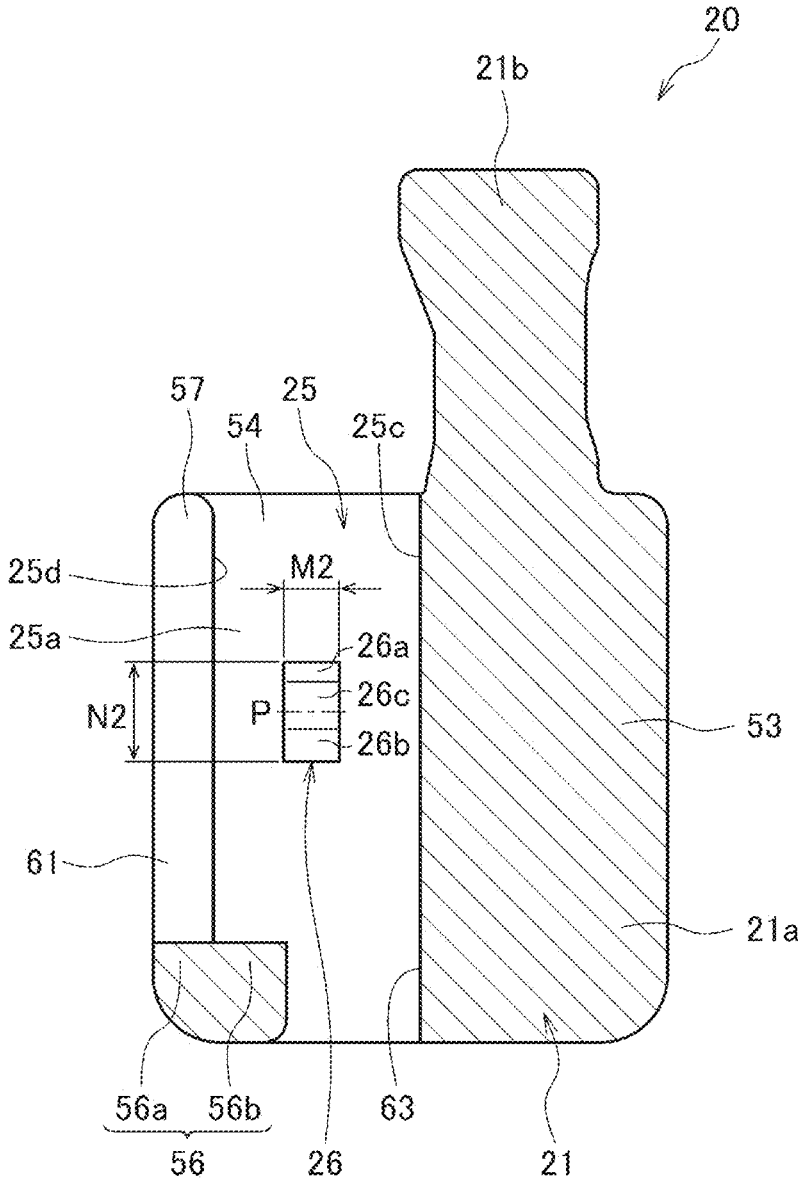
FIG. 13B is a rear view of the second separating insert portion as viewed from the back surface side, and is a cross-sectional view of the retainer taken along a line B-B in FIG. 12C.
Figure 13C:
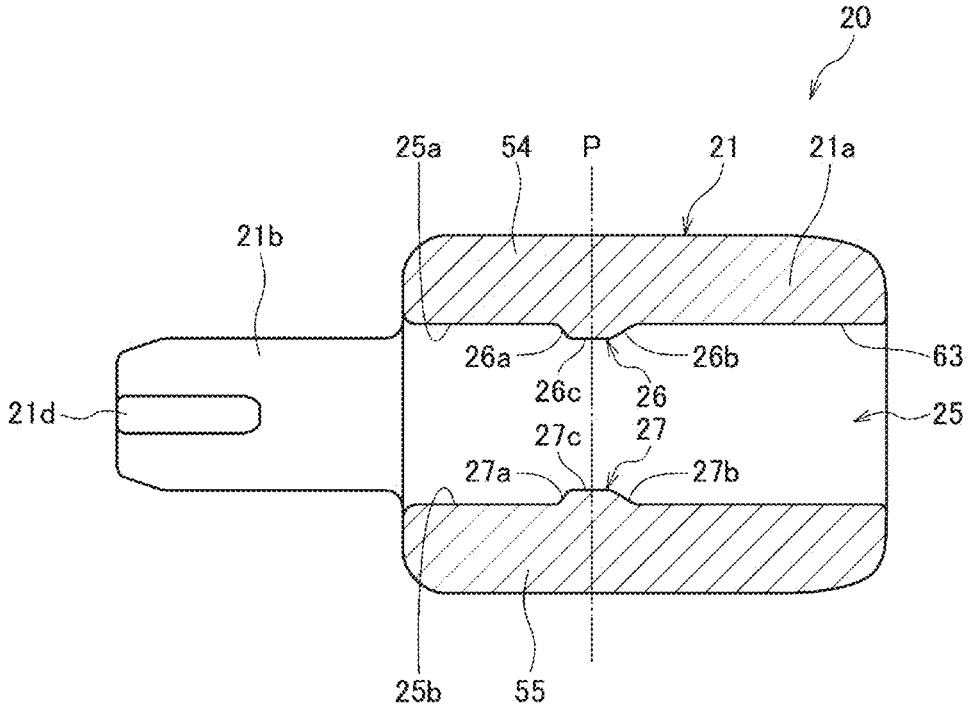
FIG. 13C is a left side view of the second separating insert portion as viewed from a left side, and is a cross-sectional view of the retainer taken along a line C-C in FIG. 12A.

FIG. 9 is an enlarged perspective view showing a decoupling state of the first and second separating insert portions 10, 20 in the slide fastener 100 according to the second embodiment. FIG. 10 is a perspective view of the first separating insert portion 10 and the second separating insert portion 20. FIG. 11A is a front view of the first separating insert portion 10 as viewed from the front surface side, FIG. 11B is a rear view of the first separating insert portion 10 as viewed from the back surface side, and FIG. 11C is a right side view of the first separating insert portion 10 as viewed from the width direction right side. FIG. 12A is a front view of the second separating insert portion 20 as viewed from the front surface side, FIG. 12B is a rear view of the second separating insert portion 20 as viewed from the back surface side, and FIG. 12C is a left side view of the second separating insert portion 20 as viewed from the width direction left side. FIG. 13A is a front view of the second separating insert portion 20 as viewed from the front surface side, and is a cross-sectional view of the retainer 21 taken along a line A-A in FIG. 12C. FIG. 13B is a rear view of the second separating insert portion 20 as viewed from the back surface side, and is a cross-sectional view of the retainer 21 taken along a line B-B in FIG. 12C. FIG. 13C is a left side view of the second separating insert portion 20 as viewed from a left side, and is a cross-sectional view of the retainer 21 taken along a line C-C in FIG. 12A.

Since most of the separable pin 11 of the first separating insert portion 10 and the retainer 21 of the second separating insert portion 20 according to the second embodiment are substantially the same as those of the first embodiment, the same portions are denoted by the same reference sings, and the description thereof will be simplified or omitted.

As shown in FIG. 9 and the like, the retainer pin 21*b* includes a locking portion 21*d* protruding toward the first tape 31*a* from an upper end portion of a surface on the first tape 31*a* side among left and right side surfaces of the retainer pin 21*b*. The locking portion 21*d* is formed in a central portion in the front-back direction of the retainer pin 21*b*. As shown in FIG. 11C, a locking groove portion 11*e* for accommodating the locking portion 21*d* is formed to be recessed in an upper end portion of a surface on the second tape 31*b* side among left and right side surfaces of the separable pin 11.

Figure 14:
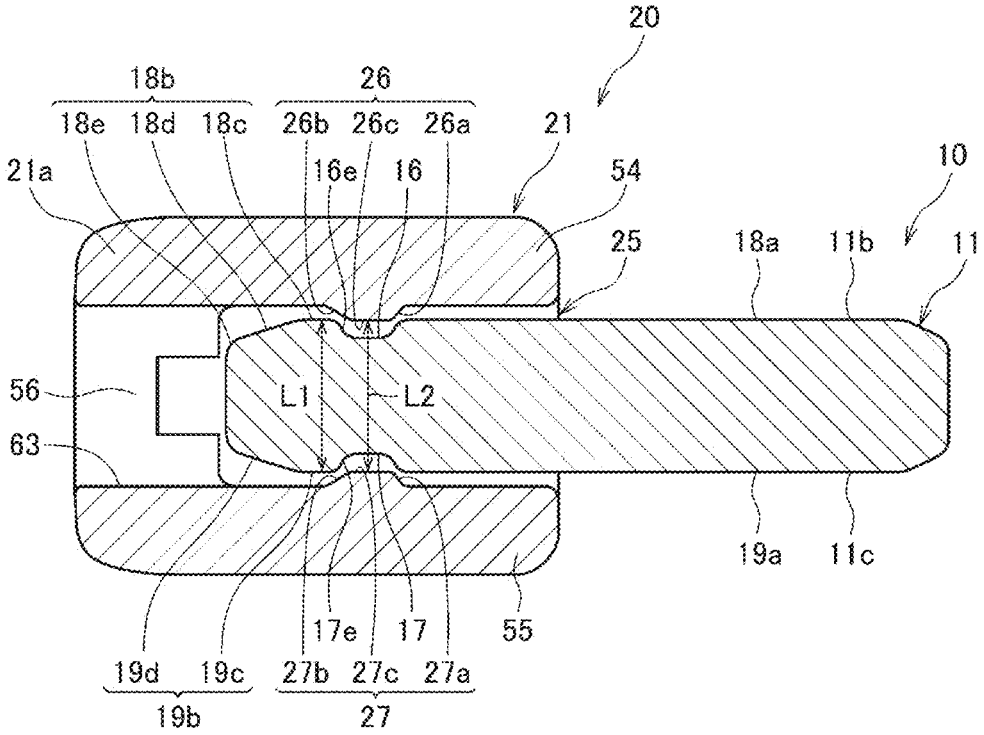
FIG. 14 is a partial cross-sectional view showing a state where a separable pin is inserted into a separable pin hole of a retainer as viewed from the width direction.

FIG. 14 is a partial cross-sectional view showing a state where the separable pin 11 is inserted into the separable pin hole 25 of the retainer 21 as viewed from the width direction. In FIG. 14, the retaining box 21*a* of the retainer 21 is shown, while the retainer pin 21*b* is not shown. As in the first embodiment, as shown in FIG. 14, in a state where the separable pin 11 is completely inserted into the separable pin hole 25 of the retainer 21, the front side convex portion 26 and the back side convex portion 27 of the retainer 21 are engaged with the front side recess 16 and the back side recess 17 of the separable pin 11, so that the separable pin 11 is prevented from coming out of the retainer 21. Therefore, the separable pin 11 is not displaced after the separable pin 11 is assembled into the retainer 21, so that the element misassembly is unlikely to occur, and the slider 40 is easily pulled up.

As in the first embodiment, also in the present embodiment, the inclination of the upper inclined surfaces 26*a*, 27*a* is larger than the inclination of the lower inclined surfaces 26*b*, 27*b*, and the inclination of the upper inclined surfaces 26*a*, 27*a* that are brought into contact with the separable pin when the separable pin 11 is inserted into the separable pin hole 25 is relatively steep. Therefore, the force Fin required to insert the separable pin 11 into the separable pin hole 25, that is, a force required for the separable pin 11 to ride over and engage with the convex portions 26, 27, is set to be relatively large. Specifically, Fin is set to 4 N to 6 N. A method for measuring Fin will be described later.

Therefore, a relatively large force is required to completely insert the separable pin 11 into the separable pin hole 25, so that the user can get an insertion feeling or a click feeling, and can appropriately recognize that the separable pin 11 is completely inserted into the retainer 21 due to resistance feeling and a sound when the separable pin 11 rides over the convex portions 26, 27.

When the separable pin 11 is removed upward (rightward in FIG. 14) from the state of FIG. 14, the lower end portion (left end portion in FIG. 14) of the separable pin 11 interferes with the pair of front and back convex portions 26, 27 of the separable pin hole 25 as in the case of insertion.

As in the first embodiment, also in the second embodiment, the inclination of the lower inclined surfaces 26*b*, 27*b* is smaller than the inclination of the upper inclined surfaces 26*a*, 27*a*, and the inclination of the lower inclined surfaces 26*b*, 27*b* that are brought into contact with the separable pin when the separable pin 11 is removed from the separable pin hole 25 is relatively gentle. Therefore, the force Fout required to remove the separable pin 11 from the separable pin hole 25, that is, a force required for the separable pin 11 to ride over the convex portions 26, 27 and release the engagement, is set to be relatively small. Specifically, Fout is set to be smaller than Fin. A method for measuring Fin will be described later.

Other effects of the second embodiment are similar to those of the first embodiment.

Method for Manufacturing Retainer

A method for manufacturing the retainer 21 according to the first and second embodiments of the present invention described above uses injection molding using a resin as a raw material. Hereinafter, the method for manufacturing the retainer 21 according to the second embodiment will be described, but the same method can also be applied to the retainer 21 according to the first embodiment (portions of the retaining box 21*a* and the retainer pin 21*b* excluding the second reinforcing strip portion 22 and the second coupling portion 23).

Figure 15:
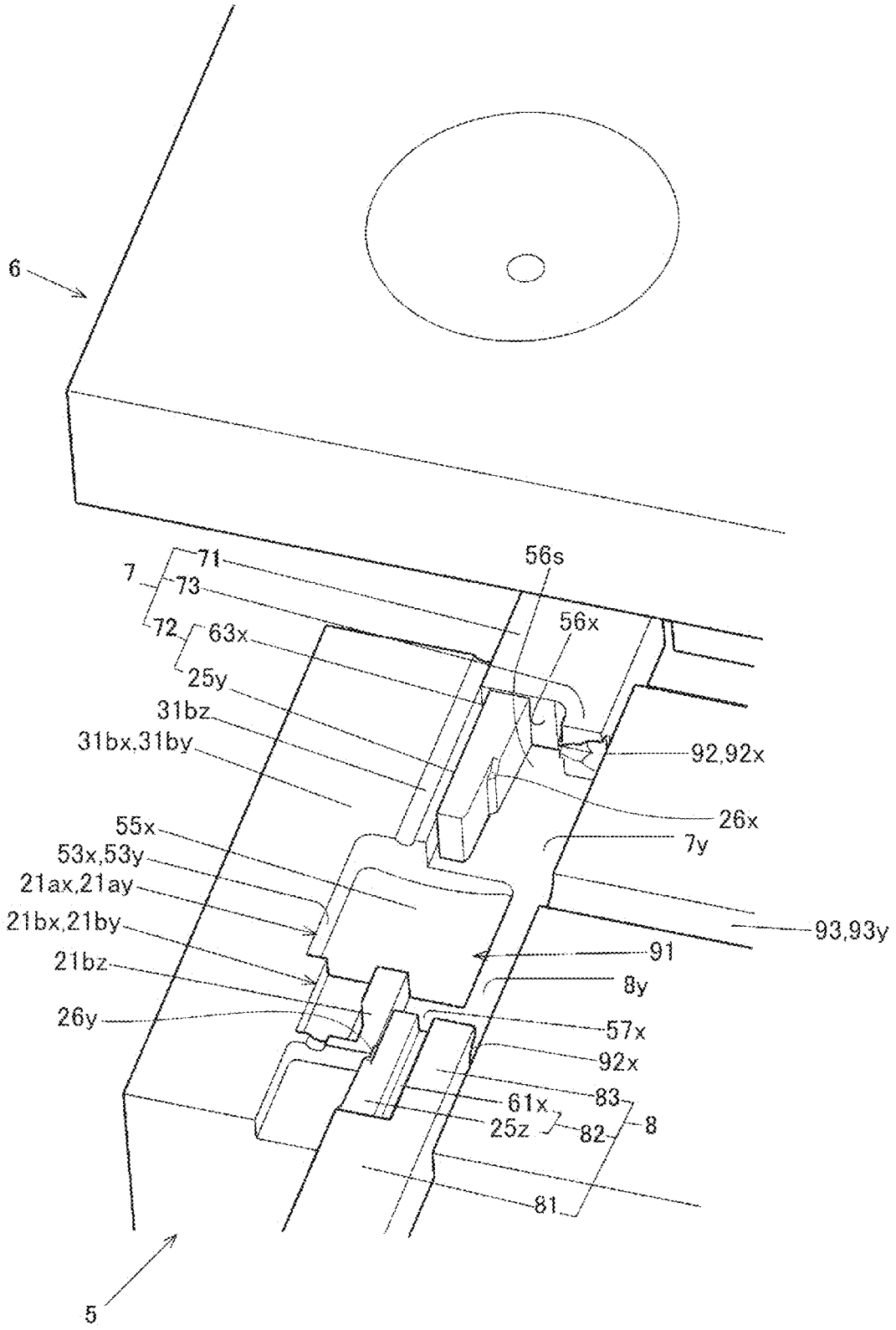
FIG. 15 is a perspective view showing a molding mold used in a method for manufacturing a retainer.

FIG. 15 is a perspective view showing a molding mold used in a method for manufacturing a retainer. Here, (a) of FIG. 16 is a side view of first and second slides in a mold opening state as viewed from the width direction, (b) of FIG. 16 is a front view of the first and second slides in the mold opening state as viewed from the front surface side, and (c) of FIG. 16 is a top view of the first slide as viewed from above. In addition, (a) of FIG. 17 is a side view of the first and second slides in a mold clamping state as viewed from the width direction, and (b) of FIG. 17 is a front view of the first and second slides in the mold clamping state as viewed from the front surface side. In addition, (a) to (g) of FIG. 18 are process diagrams showing procedures of an injection molding method.

As shown in FIG. 15, the injection molding mold used in this manufacturing method includes a fixed mold 5, a movable mold 6 supported to be capable of reciprocating in the front-back direction with respect to the fixed mold 5, and first and second slides 7, 8 capable of reciprocating in the upper-lower direction with respect to the fixed mold 5.

In the mold clamping state, the injection molding mold forms a cavity 91 as a space corresponding to a shape of the retainer 21, a gate 92 which is a gate 92 for shaping an outer shape of the gate resin portion 92*r* as a passage communicating with the cavity 91, and a runner 93 as a passage communicating with the gate 92.

The cavity 91 includes a retainer pin recess 21*bx* that shapes an outer shape of the retainer pin 21*b*, a retaining box recess 21*ax* that shapes an outer surface (so-called six surfaces) of the outer shape of the retaining box 21*a*, and a convex portion (tape groove convex portion 61*x*, separable pin hole convex portion 25*x*, slide hole convex portion 63*x*) that shapes an inner surface (tape groove 61, separable pin hole 25, slide hole 63) of the outer shape of the retaining box 21*a*.

The retaining box recess 21*ax* includes an upper-lower extension wall recess 53*x* that shapes an outer surface of the upper-lower extension wall 53 (side surface on the second tape 31*b* side of the left and right side surfaces of the retaining box 21*a*, a part of a front surface of the retaining box 21*a*, and a part of a back surface of the retaining box 21*a*), a front side body wall recess 54*x* and a back side body wall recess 55*x* that shape outer surfaces of the front side body wall 54 and the back side body wall 55, respectively, a joining wall recess 56*x* that shapes an outer surface of the joining wall 56 (a part of the back surface and a part of a side surface of the retaining box 21*a*), and a groove wall recess 57*x* that shapes an outer surface of the groove wall 57 (a part of the side surface of the retaining box 21*a*). Although the front side body wall recess 54*x* is not shown in FIG. 15, the front side body wall recess 54*x* is provided in the movable mold 6 to face the back side body wall recess 55*x*.

The convex portion includes the tape groove convex portion 61*x* that shapes the tape groove 61, the separable pin hole convex portion 25*x* (opposite-tape groove side part convex portion 25*y* and groove side part convex portion 25*z*) that shapes the separable pin hole 25, and the slide hole convex portion 63*x* that shapes the slide hole 63.

In the present embodiment, a parting line formed in the retainer 21 serving as a product is an intermediate position of the entire width in the front-back direction of the retainer 21. Therefore, the fixed mold 5 and the movable mold 6 are formed to have a front-back symmetrical shape. On the front surface of the fixed mold 5 (surface abutting against the movable mold 6), a retainer pin semi-recessed portion 21*by*, which is a back half of the retainer pin recess 21*bx*, an upper-lower extension wall semi-recessed portion 53*y*, which is a back half of the back side body wall recess 55*x* and the upper-lower extension wall recess 53*x* among the retaining box semi-recessed portion 21*ay* which is a back half of the retaining box recess 21*ax*, and a runner semi-recessed portion 93*y*, which is a back half of the runner 93, are formed in a recessed state.

On the front surface of the fixed mold 5, a tape placement semi-recessed portion 31*by*, which is a back half of the tape placement recess 31*bx* for placing the second tape 31*b*, is formed in a recessed state to vertically communicate with the side of the retainer pin semi-recessed portion 21*by* and the upper-lower extension wall semi-recessed portion 53*y* (side opposite to the runner semi-recessed portion 93*y*). A depth of the tape placement semi-recessed portion 31*by* is half a thickness of the second tape 31*b*. Of the left and right end portions of the second tape 31*b*, an end portion to which the element 32 is fixed is formed thicker in a thickness direction of the tape than the other portion. In order to position the thicker portion, a part (positioning portion) 31*bz* of the tape placement semi-recessed portion 31*by* is formed deep.

On the front surface of the fixed mold 5, first and second reciprocating recesses 7*y*, 8*y* for moving the back halves of the first and second slides 7, 8 to be reciprocated are formed to vertically communicate with each other and also communicate with the retaining box semi-recessed portion 21*ay*. More specifically, the first and second reciprocating recesses 7*y*, 8*y* are formed to communicate with the side opposite to the tape placement semi-recessed portion 31*by* in the left-right direction of the retaining box semi-recessed portion 21*ay*.

The first reciprocating recess 7*y* is formed to communicate with the side opposite to the tape placement semi-recessed portion 31*by* with respect to the upper-lower extension wall semi-recessed portion 53*y* and to communicate with the lower side with respect to the back side body wall recess 55*x*.

The second reciprocating recess 8*y* is formed on an opposite side of the tape placement semi-recessed portion 31*by* with respect to the retainer pin semi-recessed portion 21*by* at an interval. More specifically, the second reciprocating recess 8*y* is formed on a side of the wall 21*bz* opposite to the tape placement semi-recessed portion 31*by* among left and right walls forming the retainer pin semi-recessed portion 21*by*. Further, the second reciprocating recess 8*y* is formed to communicate with the upper side and the lateral side (side opposite to the upper-lower extension wall semi-recessed portion 53*y*) with respect to the back side body wall recess 55*x* in the retaining box semi-recessed portion 21*ay*.

Since the movable mold 6 has a symmetrical shape with the fixed mold 5, the front side body wall recess 54*x*, a front half of the upper-lower extension wall recess 53*x*, a front half of the retainer pin recess 21*bx*, a front half of the tape placement recess 31*bx*, and a front half of the runner 93 are formed on a front surface of the movable mold 6 (surface abutting against the fixed mold 5).

The first slide 7 includes a first base portion 71 that mainly forms a lower surface of the joining wall 56 (more specifically, an end portion on the separable pin hole 25 side of lower surfaces of the upper-lower extension walls 53 and the joining wall 56) on a lower surface side of the retaining box 21*a*, a first slide body portion 72 that protrudes upward from the tape placement semi-recessed portion 31*by* in the left-right direction on an upper surface of the first base portion 71, and a first side surface forming portion 73 that forms a side surface (a side surface on the tape groove 61 side) of the joining wall 56, which is a side surface of the retaining box 21*a*, and protrudes upward from the first base portion 71.

The first slide body portion 72 has a rod shape extending vertically, and includes the slide hole convex portion 63*x* that protrudes upward from the first base portion 71 to shape the slide hole 63, and the opposite-tape groove side part convex portion 25*y* that shapes a portion of the separable pin hole convex portion 25*x* opposite to the tape groove 61 and protrudes upward from the slide hole convex portion 63*x*. An upper end surface of the opposite-tape groove side part convex portion 25*y* is a surface abutting against the wall 21*bz* opposite to the tape placement semi-recessed portion 31*by* among left and right walls forming the retainer pin semi-recessed portion 21*by*.

The opposite-tape groove side part convex portion 25*y* includes a first base 25*ya* that is connected to the slide hole convex portion 63*x* and extends upward, and a first tip end portion 25*yb* that is connected to the first base 25*ya* and extends upward.

The first base 25*ya* is obtained by extending the entire upper end portion of the slide hole convex portion 63*x* upward. Therefore, a cross-sectional shape of the first base 25*ya* is of a rod shape having a rectangular cross-sectional shape substantially the same as a cross-sectional shape of the slide hole convex portion 63*x*.

The first tip end portion 25*yb* has a rod shape having a rectangular cross section, and extends upward from a portion of an upper end portion of the first base 25*ya* on the second tape 31*b* side (tape placement recess 31*bx* side for placing the second tape 31*b*) instead of the entire upper end portion of the first base 25*ya*. Therefore, a thickness in the front-back direction of the first tip end portion 25*yb* is equal to a thickness in the front-back direction of the first base 25*ya*, but a width in the left-right direction of the first tip end portion 25*yb* is smaller than a width in the left-right direction of the first base 25*ya*. Therefore, the opposite-tape groove side part convex portion 25*y* is formed in a stepped rod shape by the first base 25*ya* having the larger width in the left-right direction and the first tip end portion 25*yb* having the smaller width in the left-right direction.

Further, the first tape 31*a* side (runner 93 side) of the upper end portion of the first base 25*ya* has a first recess 26*x* recessed in a concave shape toward a back surface side, and the first recess 26*x* shapes the front side convex portion 26 together with a second recess 26*y* to be described later.

The first recess 26*x* has a shape corresponding to a lower half portion of the front side convex portion 26 in order to shape the lower half portion of the front side convex portion 26. That is, a bottom surface of the first recess 26*x* includes a lower inclined surface forming portion 26*bx* that shapes the lower inclined surface 26*b* of the front side convex portion 26 and is inclined to the back side as going toward the upper side from a lower end portion of the first recess 26*x* to increase a depth of the first recess 26*x* in the front-back direction, and a parallel surface lower half portion forming portion 26*cxa* that shapes a lower half portion of the parallel surface 26*c* of the front side convex portion 26 and is parallel to the upper-lower direction and the width direction. An upper end edge 28*x* of the parallel surface lower half portion forming portion 26*cxa* is a tapered surface toward the second tape 31*b* side (tape placement recess 31*bx* side for placing the second tape 31*b*) as going upward, and the tapered surface becomes an abutting surface with a tapered surface of a lower end edge 28*y* of a parallel surface upper half portion forming portion 26*cxb* to be described later.

The second slide 8 includes a second base portion 81 that is on an upper surface side of the retaining box 21*a* and forms the tape groove 61 side with respect to the upper-lower extension wall 53, the groove side part convex portion 25*z* that shapes the tape groove 61 side of the left and right of the separable pin hole convex portion 25*x*, the tape groove convex portion 61*x*, and a second side surface forming portion 83 that forms a side surface of the groove wall 57 of the side surfaces of the retaining box 21*a*. A second slide body portion 82 is formed by the groove side part convex portion 25*z* and the tape groove convex portion 61*x*. The groove side part convex portion 25*z*, the tape groove convex portion 61*x*, and the second side surface forming portion 83 protrude downward from a lower surface of the second base portion 81 in order from the retainer pin recess 21*bx* side toward the opposite side (runner 93 side) in the left-right direction. Lower end surfaces of the groove side part convex portion 25*z*, the tape groove convex portion 61*x*, and the second side surface forming portion 83 are flush with one another in the left-right direction.

The groove side part convex portion 25*z* includes the second base 25*za* that extends downward from a lower surface of the second base portion 81, and a second tip end portion 25*zb* that is connected to the second base 25*za* and extends downward.

The second base 25*za* has a rod shape having a rectangular cross section. The second tip end portion 25*zb* has a rod shape having a rectangular cross section, and extends downward from a portion of a lower end portion of the second base 25*za* on the first tape 31*a* side (runner 93 side) instead of the entire lower end portion of the second base 25*za*. Therefore, a thickness in the front-back direction of the second tip end portion 25*zb* is equal to a thickness in the front-back direction of the second base 25*za*, but a width in the left-right direction of the second tip end portion 25*zb* is smaller than a width in the left-right direction of the second base 25*za*. Thus, the groove side part convex portion 25*z* is formed in a stepped rod shape by the second base 25*za* having the larger width in the left-right direction and the second tip end portion 25*zb* having the smaller width in the left-right direction.

Further, on the second tape 31*b* side (tape placement recess 31*bx* side for placing the second tape 31*b*) of the lower end portion of the second base 25*za*, the second recess 26*y* that has a recessed shape toward the back surface side and shapes the front side convex portion 26 together with the above-described first recess 26*x* is recessed.

The second recess 26*y* has a shape corresponding to an upper half portion of the front side convex portion 26 in order to shape the upper half portion of the front side convex portion 26. That is, a bottom surface of the second recess 26*y* includes an upper inclined surface forming portion 26*ax* that shapes the upper inclined surface 26*a* of the front side convex portion 26 and is inclined to the back side as going toward the lower side from an upper end portion of the first recess 26*x* to increase a depth of the second recess 26*y* in the front-back direction, and a parallel surface upper half portion forming portion 26*cxb* that shapes an upper half portion of the parallel surface 26*c* of the front side convex portion 26 and is parallel to the upper-lower direction and the width direction. The lower end edge 28*y* of the parallel surface upper half portion forming portion 26*cxb* is a tapered surface toward the first tape 31*a* side (side opposite to the tape placement recess 31*bx* for placing the second tape 31*b*) as going downward, and the tapered surface becomes an abutting surface with a tapered surface of the upper end edge 28*x* of the parallel surface lower half portion forming portion 26*cxa*.

As shown in FIG. 17, in the mold clamping state, a side surface of the groove side part convex portion 25*z* on the second tape 31*b* side (tape placement recess 31*bx* side) and a side surface of the opposite-tape groove side part convex portion 25*y* on the first tape 31*a* side (runner 93 side) are in surface contact with each other, so that the groove side part convex portion 25*z* and the opposite-tape groove side part convex portion 25*y* form the separable pin hole convex portion 25*x* for shaping the separable pin hole 25.

Further, in the state shown in (a) and (b) of FIG. 17, the lower end edge 28*y* of the parallel surface upper half portion forming portion 26*cxb* and the tapered surface of the upper end edge 28*x* of the parallel surface lower half portion forming portion 26*cxa* are in surface contact with each other, so that the first recess 26*x* of the opposite-tape groove side part convex portion 25*y* and the second recess 26*y* of the groove side part convex portion 25*z* abut against each other in the upper-lower direction, and the front side convex portion forming portion 26*z* for shaping the front side convex portion 26 is formed.

Since the front side convex portion forming portion 26*z* including the first recess 26*x* and the second recess 26*y* has a shape corresponding to the front side convex portion 26, the inclination of the upper inclined surface forming portion 26*ax* of the second recess 26*y* is larger than the inclination of the lower inclined surface forming portion 26*bx* of the first recess 26*x* so as to correspond to the inclination of the upper inclined surface 26*a* of the front side convex portion 26 being larger than the inclination of the lower inclined surface 26*b*.

In FIG. 15 to (b) of FIG. 17, only front sides of the first slide 7 and the second slide 8 are shown, so that only the first recess 26*x* and the second recess 26*y* of the front side convex portion forming portion 26*z* that shapes the front side convex portion 26 have been described. However, the first slide 7 and the second slide 8 have a front-back symmetrical shape, and a back side convex portion forming portion that shapes the back side convex portion 27 is provided on a back side of the first slide 7 and the second slide 8. The back side convex portion forming portion includes a recess (not shown) provided on a back surface of the opposite-tape groove side part convex portion 25*y* symmetrically with the first recess 26*x* and a recess (not shown) provided on a back surface of the groove side part convex portion 25*z* symmetrically with the second recess 26*y*. At the time of mold clamping, a pair of recesses (not shown) are abutted with each other in the upper-lower direction, and a back side convex portion forming portion for shaping the back side convex portion 27 is formed. The detailed structure of the back side convex portion forming portion will be omitted because the above description of the front side convex portion forming portion 26*z* is applicable.

By the groove side part convex portion 25*z*, the tape groove convex portion 61*x*, and the second side surface forming portion 83, space portions corresponding to a shape of the groove wall 57 are respectively formed on the front and back surfaces of the tape groove convex portion 61*x*. Therefore, the tape groove convex portion 61*x* is formed to be stepped in the front-back direction with respect to the groove side part convex portion 25*z* and the second side surface forming portion 83. In other words, the tape groove convex portion 61*x* is disposed at an intermediate portion of the entire width of the front and back surfaces of both the groove side part convex portion 25*z* and the second side surface forming portion 83.

As shown in FIG. 15 and (a) to (c) of FIG. 16, the gate 92 is formed on a surface abutting against the first and second side surface forming portions 73, 83. The gate 92 extends in the left-right direction, and an inlet portion and an outlet portion of the molten resin in the gate 92 are formed in different shapes (in the shown example, a shape of the inlet portion is circular, and a shape of the outlet portion is rectangular). Moreover, the inlet portion of the molten resin in the gate 92 is formed with an inlet recess 92*x* of the recess corresponding to half the shape of the inlet portion in the first and second side surface forming portions 73, 83, and the outlet portion of the molten resin in the gate 92 is formed with an outlet recess 92*y* of the recess only in the first side surface forming portion 73 and also formed with a plane 92*z* (see (a) to (c) of FIG. 16 and (a) and (b) of FIG. 17) that closes the outlet recess 92*y* in the second side surface forming portion 83.

In a state where the injection molding mold shown in (a) and (b) of FIG. 17 is clamped, when the movable mold 6 is abutted with the fixed mold 5, the first slide body portion 72 of the first slide 7 in a state of being moved forward to the upper side is abutted with the fixed mold 5, and the second slide 8 in a state of being moved forward to the lower side is abutted against the first slide 7. When the first and second slides 7, 8 abut against each other, a joining wall space 56*s* corresponding to the shape of the joining wall 56 is formed by the first slide 7 (the slide hole convex portion 63*x* of the first slide body portion 72, the first base portion 71, and the first side surface forming portion 73) and the second slide 8 (lower end surfaces of the groove side part convex portion 25*z* of the separable pin hole convex portion 25*x* and the tape groove convex portion 61*x* of the second slide 8). The joining wall space 56*s* is a space portion corresponding to the shapes of the groove closing portion 56*a* and the hole closing portion 56*b* of the joining wall 56, and is a closed space portion that corresponds to a shape of a portion of the cavity 91 that closes both a lower side portion of the separable pin hole 25 on a tape groove 61 side and a lower side portion of the tape groove 61.

An embodiment of a method for molding the retainer 21 using the above-described injection molding mold will be described.

(1) First, as shown in (a) of FIG. 18, the injection molding mold is in a mold opening state. As shown in (b) of FIG. 18, a step of placing the second tape 31*b* on the fixed mold 5 is performed. Specifically, one end portion of the second tape 31*b* in the left-right direction is placed and positioned on a positioning portion 31*bz* (see FIG. 15) of the tape placement recess 31*bx* of the fixed mold 5. As a result, one side in the width direction of the second tape 31*b* is disposed on the cavity 91 side, and another side in the width direction is disposed on a side separated from the cavity 91.

At this time, in the present embodiment, as shown in FIG. 15 and (a) to (c) of FIG. 16, it is assumed that the first slide 7 is disposed in a state (backward movement state) in which the first slide 7 is retracted below the back side body wall recess 55*x*, and the second slide 8 is disposed in a state (backward movement state) in which the second slide 8 is retracted above the back side body wall recess 55*x*.

(2) Next, as shown in (c) of FIG. 18, a mold clamping step is performed. Specifically, the movable mold 6 is moved forward in the front-back direction with respect to the fixed mold 5, and the fixed mold 5 and the movable mold 6 are abutted against each other. In accordance with the forward movement, the first and second slides 7, 8 are moved forward in the upper-lower direction (the first slide 7 is moved forward to the upper side and the second slide 8 is moved forward to the lower side) so as to change from a state shown in FIG. 15 and (a) to (c) of FIG. 16 to a state shown in (a) and (b) of FIG. 17, a lower end surface of the upper-lower extension wall recess 53*x* of the retainer pin recess 21*bx* of the fixed mold 5 is abutted against an upper end surface of the retainer pin recess 21*bx* of the first slide 7, and a lower end surface of the second side surface forming portion 83 of the second slide 8 is abutted against an upper end surface of the first side surface forming portion 73 of the first slide 7. Accordingly, when the cavity 91, the gate 92, and the runner 93 are formed, the cavity 91, the gate 92, and the runner 93 are communicated with each other so that the molten resin passes therethrough. At this time, the opposite-tape groove side part convex portion 25*y* of the first slide 7 and the groove side part convex portion 25*z* of the second slide 8 are in surface contact with each other in the left-right direction, and the separable pin hole convex portion 25*x* is formed. As described above with reference to (a) and (b) of FIG. 17, the lower end edge 28*y* of the parallel surface upper half portion forming portion 26*cxb* and the tapered surface of the upper end edge 28*x* of the parallel surface lower half portion forming portion 26*cxa* come into surface contact with each other, so that the first recess 26*x* of the opposite-tape groove side part convex portion 25*y* and the second recess 26*y* of the groove side part convex portion 25*z* abut against each other in the upper-lower direction, and the front side convex portion forming portion 26*z* for shaping the front side convex portion 26 is formed. Similarly, although not shown, a back side convex portion forming portion that shapes the back side convex portion 27 is formed.

The first and second slides 7, 8 are moved forward, for example, by using a structure of an angular pin protruding from one mold of the fixed mold 5 and the movable mold 6 toward another mold and a guide hole for guiding the angular pin and formed in the other mold, or by driving a dedicated motor. When the first and second slides 7, 8 are reciprocated by a dedicated motor, the dedicated motor does not necessarily have to be driven at the same time as the mold clamping step, and may be driven before or after the mold clamping step.

(3) Next, as shown in (c) of FIG. 18, an injection step of injecting a molten resin is performed. The molten resin is injected into the cavity 91 through the runner 93 and the gate 92. Then, the molten resin enters the joining wall space 56*s* (closed space portion) from the gate 92, and immediately thereafter collides with the first slide 7 (more specifically, the slide hole convex portion 63*x* of the first slide body portion 72). It is assumed that the colliding molten resin is forced to change its path and proceeds to form the front side body wall 54 and the back side body wall 55. Then, as shown in (d) of FIG. 18, the cavity 91 is filled with the molten resin. A collision surface of the slide hole convex portion 63*x* is a surface orthogonal to the left-right direction in the shown example.

(4) When a predetermined time elapses after the injection, the resin is cooled to such an extent that a shape of the resin can be sufficiently maintained, and thus a mold opening step is performed as shown in (e) of FIG. 18. Specifically, the movable mold 6 is moved backward. When an angular pin is used, the first and second slides 7, 8 are moved backward simultaneously with the backward movement of the movable mold 6, or when an angular pin is not used, a dedicated motor is driven to move the first and second slides 7, 8 backward simultaneously, upward, or downward with the backward movement of the movable mold 6.

(5) Thereafter, as shown in (f) of FIG. 18 and (g) of FIG. 18, a runner resin portion 93*r* filled in the runner 93 and a gate resin portion 92*r* filled in the gate 92 are separated from the retainer 21 to be a product, and the retainer 21 to be a product is released from the fixed mold 5 by the ejector pin and collected.

In the retainer 21 manufactured by such a method, as described above, the inclination of the upper inclined surfaces 26*a*, 27*a* that are brought into contact with the separable pin when the separable pin 11 is inserted into the separable pin hole 25 is relatively steep, and the inclination of the lower inclined surfaces 26*b*, 27*b* that are brought into contact with the separable pin when the separable pin 11 is removed from the separable pin hole 25 is relatively gently set. Therefore, the force Fin required to insert the separable pin 11 into the separable pin hole 25 is made larger than the force Fout required to remove the separable pin 11 from the separable pin hole 25. Hereinafter, a method for measuring the forces Fin and Fout will be described.

Method for Measuring Force Fin Required to Insert Separable Pin into Separable Pin Hole The force Fin required to insert the separable pin 11 into the separable pin hole 25, that is, the force Fin required for the separable pin 11 to ride over and engage with the convex portions 26, 27 was measured by the following method.

After releasing the combination of the slide fasteners 100 according to the first and second embodiments to form a pair of first and second fastener stringers 30A, 30B, the separable pin 11 was inserted into the separable pin hole 25 of the retainer 21, and the insertion strength (insertion resistance) at that time was measured. In the measurement of the insertion strength, the first tape 31*a* provided with the separable pin 11 and the second tape 31*b* provided with the retainer 21 were respectively clamped using a tensile tester manufactured by INSTRON, and the strength (insertion resistance) obtained when at least one of the first tape 31*a* and the second tape 31*b* was pulled so that the separable pin 11 was inserted into the separable pin hole 25 of the retainer 21 was measured. At this time, the slider 40 is disposed at the lowermost position where the slider 40 abuts against the retaining box 21*a* in advance so that the separable pin 11 can be inserted into the separable pin hole 25 via the slider 40 when at least one of the first tape 31*a* and the second tape 31*b* is pulled.

FIG. 19 is a graph showing an example of a relation between an insertion distance (horizontal axis) of the separable pin 11 into the separable pin hole 25 and the insertion resistance (vertical axis). Although there may be a plurality of peaks of the insertion resistance, the first peak generated first after the start of insertion is adopted as a peak value of the insertion resistance. This is because the first peak indicates a peak generated when the separable pin 11 rides over the convex portion 26, 27.

The reason why the insertion resistance decreases after exceeding the first peak is that the separable pin 11 rides over the convex portions 26, 27 and the recesses 16, 17 of the separable pin 11 engages with the convex portions 26, 27 of the separable pin hole 25. Although the second peak may be obtained after the first peak, this second peak is generated when the lower end portion of the separable pin 11 abuts against the hole closing portion 56*b* or the like of the joining wall 56 in a case where the insertion is further continued after the recesses 16, 17 of the separable pin 11 are engaged with the convex portions 26, 27 of the separable pin hole 25, and thus the second peak is not adopted as the peak value of the insertion resistance.

The peak value in the example shown in FIG. 19 was 4.14 N, which is within the preferable range described above of 4 N to 6 N. If the peak value is within the range of 4 N to 6 N, the force is appropriate for inserting the separable pin 11 into the separable pin hole 25. Therefore, the user can get an insertion feeling or a click feeling that the separable pin 11 is inserted into the separable pin hole 25, and can appropriately recognize that the separable pin 11 is completely inserted into the retainer 21 due to resistance feeling and a sound when the separable pin 11 rides over the convex portions 26, 27.

On the other hand, if the peak value exceeds 6 N, the insertion resistance is excessive, and a large force is required for the user to insert the separable pin 11 into the separable pin hole 25, which is not preferable. In addition, the user may misunderstand that the separable pin 11 has reached the lowermost end of the separable pin hole 25 and the insertion has been completed when the separable pin 11 hits the convex portions 26, 27 before the separable pin 11 rides over the convex portions 26, 27.

On the other hand, if the peak value is less than 4 N, the insertion resistance is too small, and the user cannot obtain an appropriate insertion feeling or click feeling.

Method for Measuring Force Fout Required for Removing Separable Pin from Separable Pin Hole The force Fout required to remove the separable pin 11 from the separable pin hole 25, that is, the force Fout required for the separable pin 11 to ride over the convex portions 26, 27 and release the engagement was measured by the following method.

The separable pin 11 was removed from the separable pin hole 25 of the retainer 21 in a state where the pair of first and second fastener stringers 30A, 30B were combined, and the pull-off strength (pull-off resistance) at that time was measured. In the measurement of the pull-off strength, the first tape 31*a* provided with the separable pin 11 and a pull 42 of the slider 40 were respectively clamped using a tensile tester manufactured by INSTRON, and the strength (pull-off resistance) obtained when at least one of the first tape 31*a* and the pull 42 of the slider 40 was pulled so that the separable pin 11 was removed from the separable pin hole 25 of the retainer 21 was measured. At this time, the slider 40 is disposed at the lowermost position where the slider 40 abuts against the retaining box 21*a* in advance so that the separable pin 11 can be removed from the separable pin hole 25 via the slider 40 when at least one of the first tape 31*a* and the pull 42 of the slider 40 is pulled.

FIG. 20 is a graph showing an example of a relation between a pull-off distance (horizontal axis) of the separable pin 11 from the separable pin hole 25 and a pull-off resistance (vertical axis). A peak value of the pull-off resistance in the graph is adopted as the force Fout required to remove the separable pin 11 from the separable pin hole 25.

Further, the present invention is not limited to the above embodiments, and can be appropriately modified, improved, and the like within the practicable scope.

As described above, the following matters are disclosed in this specification.

[1] A slide fastener (100) including:

a pair of first and second fastener stringers (30A, 30B);

at least one slider (40) configured to open and close a space between the first and second fastener stringers (30A, 30B); and a separating insert (1) provided at a lower end portion of the first and second fastener stringers (30A, 30B) in a longitudinal direction, in which the separating insert (1) includes a first separating insert portion (10) provided on the first fastener stringer (30A), and a second separating insert portion (20) provided on the second fastener stringer (30B) and capable of being coupled to and decoupled from the first separating insert portion (10), the first separating insert portion (10) includes a separable pin (11) provided on a width direction inner edge side of the first fastener stringer (30A), the second separating insert portion (20) includes a retainer (21) provided on a width direction inner edge side of the second fastener stringer (30B), the retainer (21) includes a separable pin hole (25) which opens to an upper side and into or from which the separable pin (11) can be inserted or removed in the longitudinal direction, at least one of a front surface (11*b*) and a back surface (11*c*) of the separable pin (11) is provided with a recess (16, 17), among inner surfaces (25*a*, 25*b*, 25*c*, 25*d*) forming the separable pin hole (25) of the retainer (21), at least one of a front side surface (25*a*) and a back side surface (25*b*) facing the front surface (11*b*) and the back surface (11*c*) of the separable pin (11) is provided with a convex portion (26, 27) engageable with the recess (16, 17), the convex portion (26, 27) has a non-symmetrical shape with respect to a plane (P) passing through a central portion of the convex portion (26, 27) in an insertion or removal direction of the separable pin (11) and perpendicular to the insertion or removal direction, the convex portion (26, 27) includes an upper inclined surface (26*a*, 27*a*) that increases a thickness of the convex portion (26, 27) downward from an upper end portion of the convex portion (26, 27) in the insertion or removal direction of the separable pin (11), and a lower inclined surface (26*b*, 27*b*) that increases the thickness of the convex portion (26, 27) upward from a lower end portion of the convex portion (26, 27) in the insertion or removal direction of the separable pin (11), and an inclination of the upper inclined surface (26*a*, 27*a*) is larger than an inclination of the lower inclined surface (26*b*, 27*b*).

According to this configuration, a relatively large force is required to completely insert the separable pin (11) into the separable pin hole (25), so that the user can get an insertion feeling or a click feeling, and can appropriately recognize that the separable pin (11) is completely inserted into the retainer (21) due to resistance feeling and a sound when the separable pin (11) rides over the convex portions (26, 27).

[2] The slide fastener according to [1], in which a force (Fin) required to insert the separable pin (11) into the separable pin hole (25) is larger than a force (Fout) required to remove the separable pin (11) from the separable pin hole (25).

According to this configuration, a relatively large force is required to completely insert the separable pin (11) into the separable pin hole 25, so that the user can get an insertion feeling or a click feeling, and can appropriately recognize that the separable pin (11) is completely inserted into the retainer (21) due to resistance feeling and a sound when the separable pin (11) rides over the convex portions (26, 27).

[3] The slide fastener according to [1] or [2], in which a force required to insert the separable pin (11) into the separable pin hole (25) is 4 N to 6 N.

According to this configuration, a relatively large force is required to completely insert the separable pin (11) into the separable pin hole 25, so that the user can get an insertion feeling or a click feeling, and can appropriately recognize that the separable pin (11) is completely inserted into the retainer (21) due to resistance feeling and a sound when the separable pin (11) rides over the convex portions (26, 27).

[4] The slide fastener according to any one of [1] to [3], in which the recesses (16, 17) are respectively provided on the front surface (11*b*) and the back surface (11*c*) of the separable pin (11), and the convex portions (26, 27) are respectively provided on the front side surface (25*a*) and the back side surface (25*b*) of the separable pin hole (25) of the retainer (21).

According to this configuration, the force Fin required to engage the convex portions (26, 27) with the recesses (16, 17) increases, and the user can more reliably get an insertion feeling or click feeling, and can more appropriately recognize that the separable pin (11) is completely inserted into the retainer (21).

[5] The slide fastener according to any one of [1] to [4], in which the convex portion (26, 27) includes a parallel surface (26*c*, 27*c*) that connects the upper inclined surface (26*a*, 27*a*) and the lower inclined surface (26*b*, 27*b*) and that is parallel to the insertion or removal direction and the width direction.

According to this configuration, since the convex portions (26, 27) include the parallel surfaces 26*c*, 27*c* that connect the upper inclined surfaces (26*a*, 27*a*) and the lower inclined surfaces (26*b*, 27*b*) and are parallel to the insertion or removal direction (upper-lower direction) and the width direction (left-right direction) of the separable pin (11), the convex portions (26, 27) and the recesses (16, 17) can be engaged with little rattling.

[6] The slide fastener according to any one of [1] to [5], in which the recess (16, 17) penetrates the separable pin (11) in the width direction.

According to this configuration, even if dust such as human dirt or clothes fiber enters the recesses (16, 17), the dust can be easily discharged from the recesses (16, 17) in the width direction.

[7] The slide fastener according to any one of [1] to [6], in which a length (M1) of the recess (16, 17) in the width direction is larger than a length (M2) of the convex portion (26, 27) in the width direction.

According to this configuration, the convex portions (26, 27) are easily fitted into the recesses (16, 17). For example, the separable pin (11) may be inserted while being inclined in the width direction (left-right direction) with respect to the separable pin hole (25). Even in this case, the recesses (16, 17) of the separable pin are also securely engaged with the convex portions (26, 27) of the separable pin hole 25. Further, even when the convex portions (26, 27) come into contact with the recesses (16, 17) after the engagement, the convex portions (26, 27) are elastically deformed in the width direction in the recesses (16, 17), so that local stress can be prevented from being generated in the convex portions (26, 27).

[8] The slide fastener according to any one of [1] to [7], in which when the recess (16, 17) and the convex portion (26, 27) are engaged with each other, a gap between the recess (16, 17) and the convex portion (26, 27) in the width direction is larger than a gap between the recess (16, 17) and the convex portion (26, 27) in the insertion or removal direction.

With this configuration, when the recesses (16, 17) and the convex portions (26, 27) are engaged with each other, an insertion feeling can be obtained, and the convex portions (26, 27) can be easily fitted into the recesses (16, 17).

[9] A slide fastener (100) including:

a pair of first and second fastener stringers (30A, 30B);

at least one slider (40) configured to open and close a space between the first and second fastener stringers (30A, 30B); and a separating insert (1) provided at a lower end portion of the first and second fastener stringers (30A, 30B) in a longitudinal direction, in which the separating insert (1) includes a first separating insert portion (10) provided on the first fastener stringer (30A), and a second separating insert portion (20) provided on the second fastener stringer (30B) and capable of being coupled to and decoupled from the first separating insert portion (10), the first separating insert portion (10) includes a separable pin (11) provided on a width direction inner edge side of the first fastener stringer (30A), the second separating insert portion (20) includes a retainer (21) provided on a width direction inner edge side of the second fastener stringer (30B), the retainer (21) includes a separable pin hole (25) which opens to an upper side and into or from which the separable pin (11) can be inserted or removed in the longitudinal direction, at least one of a front surface (11*b*) and a back surface (11*c*) of the separable pin (11) is provided with a recess (16, 17), among inner surfaces (25*a*, 25*b*, 25*c*, 25*d*) forming the separable pin hole (25) of the retainer (21), at least one of a front side surface (25*a*) and a back side surface (25*b*) facing the front surface (11*b*) and the back surface (11*c*) of the separable pin (11) is provided with a convex portion (26, 27) engageable with the recess (16, 17), and a force (Fin) required to insert the separable pin into the separable pin hole (25) of the retainer is larger than a force (Fout) required to remove the separable pin from the separable pin hole (25) of the retainer.

According to this configuration, a relatively large force is required to completely insert the separable pin (11) into the separable pin hole 25, so that the user can get an insertion feeling or a click feeling, and can appropriately recognize that the separable pin (11) is completely inserted into the retainer (21) due to resistance feeling and a sound when the separable pin (11) rides over the convex portions (26, 27).

[10] A method for manufacturing a retainer (21) of a slide fastener separating insert (1), in which the retainer (21) is provided with a convex portion (26, 27) on an inner surface (25*a*, 25*b*) of a separable pin hole (25) into and from which a separable pin (11) can be inserted and removed, the retainer (21) is obtained by injection molding using a fixed mold (5), a movable mold (6) provided to be capable of reciprocating in a front-back direction with respect to the fixed mold (5), and first and second slides (7, 8) provided to be capable of reciprocating in an upper-lower direction with respect to the fixed mold (5), and a convex portion forming portion (26*z*) for forming the convex portion (26, 27) is formed by abutting a first recess (26*x*) recessed in the first slide (7) against a second recess (26*y*) recessed in the second slide (8).

According to this configuration, the convex portions (26, 27) can be provided on the inner surfaces (25*a*, 25*b*) of the separable pin hole (25) of the retainer (21) by injection molding.

REFERENCE SIGNS LIST

1 separating insert
5 fixed mold
6 movable mold
7 first slide
7*y* first reciprocating recess
8 second slide
8*y* second reciprocating recess
10 first separating insert portion
11 separable pin
11*a* protrusion
11*b* front surface
11*c* back surface
11*d* lower surface
11*e* locking groove portion
12 first reinforcing strip portion
13 first coupling portion
13*a* front surface
13*b* back surface
14 step
15 thin guide portion
16 front side recess (recess)
16*a* left opening
16*b* right opening
16*c* parallel surface
16*d* upper inclined surface
16*e* lower inclined surface
17 back side recess (recess)
17*a* left opening
17*b* right opening
17*c* parallel surface
17*d* upper inclined surface
17*e* lower inclined surface
18*a* front surface upper portion
18*b* front surface lower portion
18*c* parallel surface
18*d* first inclined surface
18*e* second inclined surface
19*a* back surface upper portion
19*b* back surface lower portion
19*c* parallel surface
19*d* inclined surface
20 second separating insert portion
21 retainer
21*a* retaining box
21*ax* retaining box recess
21*b* retainer pin
21*bx* retainer pin recess
21*by* retainer pin semi-recessed portion
21*bz* wall
21*c* notch
21*d* locking portion
22 second reinforcing strip portion
23 second coupling portion
24 thin guide portion
25 separable pin hole
25*a* front side surface (inner surface)
25*b* back side surface (inner surface)
25*c* right side surface (inner surface)
25*d* left side surface (inner surface)
25*x* separable pin hole convex portion
25*y* opposite-tape groove side part convex portion
25*ya* first base
25*yb* first tip end portion
25*z* groove side part convex portion
26 front side convex portion (convex portion)
26*a* upper inclined surface
26*ax* upper inclined surface forming portion
26*b* lower inclined surface
26*bx* lower inclined surface forming portion
26*c* parallel surface
26*cxa* parallel surface lower half portion forming portion
26*cxb* parallel surface upper half portion forming portion
26*x* first recess
26*y* second recess
26*z* front side convex portion forming portion (convex portion forming portion)
27 back side convex portion (convex portion)
27*a* upper inclined surface
27*b* lower inclined surface
27*c* parallel surface
28*x* upper end edge
28*y* lower end edge
30A first fastener stringer
30B second fastener stringer
31*a* first tape
31*b* second tape
31*bx* tape placement recess
31*by* tape placement semi-recessed portion
31*bz* positioning portion
31*c* tape reinforcing portion
32 element
33 top stopper
40 slider
41 slider body
42 pull
43 upper blade
43*a* raised portion
44: lower blade
44*a* raised portion
46 pull holding portion
53 upper-lower extension wall
53*x* upper-lower extension wall recess
53*y* upper-lower extension wall semi-recessed portion
54 front side body wall
54*x* front side body wall recess
55 back side body wall
55*x* back side body wall recess
56 joining wall
56*a* groove closing portion
56*b* hole closing portion
56*s* joining wall space
56*x* joining wall recess
57 groove wall
57*x* groove wall recess
61 tape groove
61*x* tape groove convex portion
63 slide hole
63*x* slide hole convex portion
71 first base portion
72 first slide body portion
73 first side surface forming portion
81 second base portion
82 second slide body portion
83 second side surface forming portion
91 cavity
92 gate
92*r* gate resin portion
92*x* inlet recess
92*y* outlet recess
92*z* plane
93 runner
93*r* runner resin portion
93*y* runner semi-recessed portion
100 slide fastener

The invention claimed is:

1. A slide fastener comprising:

a pair of first and second fastener stringers;

at least one slider configured to open and close a space between the first and second fastener stringers; and a separating insert provided at a lower end portion of the first and second fastener stringers in a longitudinal direction, wherein the separating insert includes a first separating insert portion provided on the first fastener stringer, and a second separating insert portion provided on the second fastener stringer and capable of being coupled to and decoupled from the first separating insert portion, the first separating insert portion includes a separable pin provided on a width direction inner edge side of the first fastener stringer, the second separating insert portion includes a retainer provided on a width direction inner edge side of the second fastener stringer, the retainer includes a separable pin hole which opens to an upper side and into or from which the separable pin can be inserted or removed in the longitudinal direction, at least one of a front surface and a back surface of the separable pin is provided with a recess, among inner surfaces forming the separable pin hole of the retainer, at least one of a front side surface and a back side surface facing the front surface and the back surface of the separable pin is provided with a convex portion engageable with the recess, the convex portion has a non-symmetrical shape with respect to a plane passing through a central portion of the convex portion in an insertion or removal direction of the separable pin and perpendicular to the insertion or removal direction, the convex portion includes an upper inclined surface that increases a thickness of the convex portion downward from an upper end portion of the convex portion in the insertion or removal direction of the separable pin, and a lower inclined surface that increases the thickness of the convex portion upward from a lower end portion of the convex portion in the insertion or removal direction of the separable pin, and an inclination of the upper inclined surface is larger than an inclination of the lower inclined surface.

2. The slide fastener according to claim 1, wherein a force required to insert the separable pin into the separable pin hole is larger than a force required to remove the separable pin from the separable pin hole.

3. The slide fastener according to claim 1, wherein a force required to insert the separable pin into the separable pin hole is 4 N to 6 N.

4. The slide fastener according to claim 1, wherein the recesses are respectively provided on the front surface and the back surface of the separable pin, and the convex portions are respectively provided on the front side surface and the back side surface of the separable pin hole of the retainer.

5. The slide fastener according to claim 1, wherein the convex portion includes a parallel surface that connects the upper inclined surface and the lower inclined surface and that is parallel to the insertion or removal direction and the width direction.

6. The slide fastener according to claim 1, wherein the recess penetrates the separable pin in the width direction.

7. The slide fastener according to claim 1, wherein a length of the recess in the width direction is larger than a length of the convex portion in the width direction.

8. The slide fastener according to claim 1, wherein when the recess and the convex portion are engaged with each other, a gap between the recess and the convex portion in the width direction is larger than a gap between the recess and the convex portion in the insertion or removal direction.

9. A slide fastener comprising:

a pair of first and second fastener stringers;

at least one slider configured to open and close a space between the first and second fastener stringers; and a separating insert provided at a lower end portion of the first and second fastener stringers in a longitudinal direction, wherein the separating insert includes a first separating insert portion provided on the first fastener stringer, and a second separating insert portion provided on the second fastener stringer and capable of being coupled to and decoupled from the first separating insert portion, the first separating insert portion includes a separable pin provided on a width direction inner edge side of the first fastener stringer, the second separating insert portion includes a retainer provided on a width direction inner edge side of the second fastener stringer, the retainer includes a separable pin hole which opens to an upper side and into or from which the separable pin can be inserted or removed in the longitudinal direction, at least one of a front surface and a back surface of the separable pin is provided with a recess, among inner surfaces forming the separable pin hole of the retainer, at least one of a front side surface and a back side surface facing the front surface and the back surface of the separable pin is provided with a convex portion engageable with the recess, and an upper inclined surface and a lower inclined surface, wherein a force required to insert the separable pin into the separable pin hole of the retainer is larger than a force required to remove the separable pin from the separable pin hole of the retainer.

* * * * *